US006679449B2

(12) United States Patent
Sugiuchi

(10) Patent No.: US 6,679,449 B2
(45) Date of Patent: Jan. 20, 2004

(54) METHOD AND APPARATUS FOR WINDING WIRE

(75) Inventor: Yosuke Sugiuchi, Fukushima-ken (JP)

(73) Assignee: Nittoku Engineering Co., Ltd., Saitama (JP)

( * ) Notice: Subject to any disclaimer, the term of this patent is extended or adjusted under 35 U.S.C. 154(b) by 151 days.

(21) Appl. No.: 09/907,922

(22) Filed: Jul. 19, 2001

(65) Prior Publication Data

US 2002/0030134 A1 Mar. 14, 2002

(30) Foreign Application Priority Data

Jul. 19, 2000 (JP) ..... 2000-219809

(51) Int. Cl.[7] ..... B21F 3/04
(52) U.S. Cl. ..... 242/439.1; 242/439.4
(58) Field of Search ..... 242/443.1, 445, 242/439.1, 439.4

(56) References Cited

U.S. PATENT DOCUMENTS 2,401,954 A * 6/1946 Newton ..... 242/431
5,314,129 A * 5/1994 Rivara ..... 242/443.1
5,397,070 A * 3/1995 Yano ..... 242/443.1
5,538,196 A * 7/1996 Auchincloss et al. .... 242/443.1
5,582,357 A * 12/1996 Kosaka et al. ..... 242/443.1
5,806,781 A * 9/1998 Ujita et al. ..... 242/444.5
6,102,324 A * 8/2000 Farrow et al. ..... 242/437.2

FOREIGN PATENT DOCUMENTS

| | | | |
|---|---|---|---|
| DE | 3049406 | 7/1982 | |
| DE | 3527311 | 1/1987 | |
| EP | 0143319 | 6/1985 | |
| JP | 04067608 A * | 3/1992 | ..... H01F/41/06 |
| JP | 05326312 A * | 12/1993 | ..... H01F/41/06 |
| JP | 11-27909 | 1/1999 | |

* cited by examiner

*Primary Examiner*—Kathy Matecki
*Assistant Examiner*—Sang Kim
(74) *Attorney, Agent, or Firm*—Crowell & Moring LLP

(57) ABSTRACT

The present invention aims at providing a method of wire winding without the failure of engagement of the wire caused by the deviation of position of a nozzle and bobbin terminal. The method is characterized in that, in the case of winding wire around the outer peripheries of rotating wind-up tools of which the peripheries are parallel to their axes of rotation, each wind-up tool 8 is attached to each of a plurality of spinning bodies 6 each of which has the rotation axis same as the wind-up tool, a rotation driving source is provided for each spinning body 6 for winding the wire, and the rotation driving sources are rotated in synchronism with each other.

15 Claims, 17 Drawing Sheets

METHOD AND APPARATUS FOR WINDING WIRE

BACKGROUND OF THE INVENTION

1.Field of the Invention

The present invention relates to a method and apparatus for winding wire around the outer periphery of a rotating wind-up tool of which the periphery is parallel to its axis of rotation, or a method and apparatus for winding wire around the outer periphery of a stationary wind-up tool of which the periphery is parallel to its axial center line.

2. Description of the Related Art

Hitherto, a winding mechanism with multi-spindles in which coil bobbins are rotated or fliers are rotated around stationary coil bobbins has been well known in the art. One of such apparatuses is shown in FIG. 16.

In the drawing, a plurality of spindles 105 are driven by a motor 106 by the medium of a motor pulley, pulleys 100*a*~100*d* attached to the spindles 105, and a belt 101. This prior art is economical because only one driving source is used, but contains problems as follows:

(1) the belt 101 looped over the motor pulley and pulleys 100*a*~100*d* wears and gets longer with increasing use resulting in slack in the belt, which causes the deviation of rotation position due to the riding of the teeth of the belt across the teeth of the pulleys.

For this reason, in the case the bobbing rotates (shaft rotation type wire winder), the deviation of rotation position develops even if the motor is stopped at a predetermined position. Accordingly, when the wire paid out from a nozzle 102 is engaged to the terminal of the bobbin, failure of engagement occurs due to the deviation of position of the nozzle and terminal, and proper winding cannot be performed.

This is the same in the case of a flier type wire winder with a flier turning around the bobbin.

Even if the riding across of the teeth does not occur, there remains a problem that backlash develops in the meshing part of the teeth of the belt and pulley due to slack in the belt resulting in reduced accuracy of positioning.

(2) When the slack in the belt develops as mentioned above, it is necessary to adjust the position of idler pulleys in order to keep the tension of the belt, or to replace the belt if the slack is large, which demands much efforts for adjustment, maintenance, etc.

(3) There is a problem of short life of bearings because radial loads are exerted on the bearings of the spindles by the tension of the belt.

(4) As there are many mechanical contacting and moving parts such as the bearings of spindles, the belt and pulleys, bearings of idler pulleys, the idler pulleys and belt, etc., noise generated in these contacting parts is high, it becomes higher as the bearings wear and deteriorate.

(5) As there are many mechanical contacting and moving parts energy loss in these parts is large accompanying the problem of heat generation due to friction.

(6) As a plurality of pulleys and idler pulleys rotate together with the spindles, inertia moment is large, responsivity is poor, so there is a limit to the accuracy of motion at starting up with high speed, hard-stopping, etc.

SUMMARY OF THE INVENTION

The present invention is made to solve the problems described above. An object of the invention is to provide a method and an apparatus for winding wire without the failure of engagement of the wire caused by the deviation of position of a nozzle and bobbin terminal.

Another object of the invention is to provide a method and an apparatus for winding wire without using a belt transmission mechanism for drive a plurality of spindles by a driving source.

A further object of the invention is to provide a method and an apparatus for winding wire having superior responsivity to command signals.

The present invention is characterized in that, in a method of winding wire around the outer peripheries of a plurality of rotating wind-up tools of which the peripheries are parallel to their axes of rotation, each wind-up tool is installed on each of a plurality of spinning bodies rotatable about the same axis of rotation as that of the spinning body, an individual rotation driving source is provided for each spinning body, and wire is wound around each wind-up tool while each individual rotation source rotates in synchronism with each other.

The present invention is a method for winding wire around the outer periphery of a wind-up tool while rotating the wind-up tool, the wind-up tool may be a bobbin or a core other than bobbin, the wire being wound around the core to be formed into a coil which is removed from the core after the winding.

The invention has also a feature that, each of a plurality of wind-up tools are installed on each of a plurality of spinning bodies rotatable about the same axis of rotation as that of the spinning body, a rotation driving source is provided for each of the spinning bodies, and wire is wound around each wind-up tool while the rotation sources rotate in synchronism with each other.

By the art like this, as a rotation driving source is provided for each wind-up tool unlike the case the wind-up tools are driven by a driving source using a belt, it is possible to engage wire without the failure caused by the deviation of position of a nozzle and bobbin terminal, and further, as a belt transmission mechanism is not used for driving a plurality of spindles by a driving source, there occurs no problem of slacken belt, and a wire winding method with superior responsivity to command signals can be obtained.

Further, it is also an effective means of the present invention to establish a method in which the wires are supplied to the wind-up tools by way of nozzles, and the initial positions of the wires before winding are set by moving the nozzles up-and-down, right-and-left, and back-and-forth, or a method in which the nozzles are moved up-and-down, right-and-left, and back-and-forth corresponding to the wire winding motion to be adjusted to the proper position.

With the technical art like this, as the initial position of each of a plurality of nozzles is set on the same position, the failure of engagement of the wire due to the deviation of position of the nozzle and the terminal for engagement is prevented. Further, as nozzles are moved up-and-down, right-and-left, and back-and-forth corresponding to the wire winding motion, the winding can be performed with accuracy.

Accordingly, also thin wire can be wound with precision.

It is also an effective means of the present invention to regulate the position of each nozzle by moving each nozzle in the direction of up-and-down, right-and-left, and back-and-forth by rotating an individual rotation driving source for each direction.

It is desirable that, the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

With the technical art like this, as the feedback pulses having the same frequency as the control pulses for driving the rotation driving source, the number of rotations of the rotation driving source is detected by counting the number of the feedback pulses, and the rotation driving source is stopped in response to the detected number of the feedback pulses, the position of the nozzle can be accurately controlled. The number of rotations of the rotation driving source for rotating the spindle is controlled, so the number of rotations of the wind-up tool can also be accurately controlled.

As an apparatus for performing the present invention, here is proposed an apparatus for winding wire around the outer peripheries of a plurality of rotating wind-up tools of which the outer peripheries are parallel to their axes of rotation, wherein the apparatus comprises:

a plurality of rotatable wind-up tool holders for attaching each of the wind-up tools, a plurality of rotation driving sources each of which is connected to each wind-up tool holder for rotating each wind-up tools, and a rotation control means for controlling the rotation driving sources for rotating the wind-up tools in synchronism with each other.

In the present invention, as mentioned before, the wind-up tool may be a bobbin or a core other than bobbin, the wire being wound around the core to be formed into a coil which is removed from the core after the winding.

The invention also has a feature that, by providing a plurality of wind-up tool holders, a plurality of rotation driving sources for rotating the wind-up tools, and a rotation control means, and the wires are wound around a plurality of wind-up tools attached to a plurality of spinning bodies rotatable about their axes which coincide with the axes of the wind-up tools while the rotation sources rotate in synchronism with each other.

Accordingly, by the art like this, as a rotation driving source is provided for each wind-up tool unlike the case the wind-up tools are driven by a driving source using a belt, it is possible to engage the wires without the failure caused by the deviation of position of each nozzle and bobbin terminal, and further, as a belt transmission mechanism is not used for driving a plurality of spindles by a driving source, there occurs no problem of slacken belt, and a wire winding method with superior responsivity to command signals can be obtained.

It is an effective means of the invention to constitute the apparatus for winding wire so that it comprises:

nozzle means for supplying the wires to the wind-up tools, the tip part of each of the nozzle means facing each of the wind-up tools, rotation driving sources provided for each of the nozzle means to be moved up-and-down, right-and-left, and back and-forth, and nozzle position adjusting means for adjusting the tip part of each of the nozzles to a proper position by controlling each of the rotation driving sources; and the position of each nozzle is regulated by rotating each rotation driving source.

With the technical art like this, as the initial position of each of a plurality of nozzles is set on the same position, the failure of engagement of the wire due to the deviation of position of the nozzle and the terminal for engagement is prevented. Further, as each nozzle is moved up-and-down, right-and-left, and back-and-forth corresponding to the wire winding motion, the winding can be performed with accuracy.

Accordingly, also thin wire can be wound with precision.

It is also an effective means of the invention to constitute the apparatus for winding wire so that the rotation driving source is driven by control pulses, feedback pulses of the same frequency as the control pulses are sent out from the rotation driving source, and the number of rotations of the rotation driving source is detected by counting the number of the feedback pulses of which the frequency is the same as that of the control pulses.

With the technical art like this, as the feedback pulses having the same frequency as the control pulses for driving the rotation driving source, the number of rotations of the rotation driving source is detected by counting the number of the feedback pulses, and the rotation driving source is stopped in response to the detected number of the feedback pulse, so the positions of the nozzles can be accurately controlled. The number of rotations of the rotation driving source for rotating the spindle is controlled, so also the number of rotations of the wind-up tool can be accurately controlled.

It is also an effective means of the invention to establish a method of winding wire around the outer peripheries of a plurality of rotating wind-up tools of which the peripheries are parallel to their axes of rotation so that, each of the wind-up tools is installed on a plurality of spinning bodies each of which is rotatable about the same axis of rotation as that of each wind-up tool, a plurality of rotation driving sources are provided for each of the spinning bodies, and wire is wound around each wind-up tool while the rotation sources rotate in synchronism with each other, and further the wire is supplied to the wind-up tool by way of a nozzle which is moved in the direction of the rotation axis of the wind-up tool corresponding to the wire winding motion.

With the technical art like this, as the wire winding is done without control means of position in the vertical and right-and-left direction, the apparatus is simple and compact.

It is also an effective means of the invention to constitute the apparatus so that, the rotation driving source for moving the nozzle means consists of a first and a second rotation driving source for moving the nozzle means in the direction of the rotation axis of the wind-up tool during wire winding action, the moved distance of the nozzle means by unit rotation of the second rotation driving source is smaller than that of the first rotation driving source, and the initial position of the nozzle means is adjusted by the second rotation driving source.

With the technical art like this, the fine adjusting of the positions of the nozzles is possible by the second rotation driving sources, and the initial positions of the nozzles can be set accurately even in the case of thin wires.

It is also an effective means of the invention to constitute the apparatus so that, the rotation driving source for moving the nozzle means consists of a first and a second rotation driving source for moving the nozzle means in the direction of the rotation axis of the wind-up tool during wire winding action, the moved distance of the nozzle means by unit rotation of the second rotation driving source is smaller than that of the first rotation driving source, and the shift of the nozzle means in the wire winding part of the wind-up tool is performed by the first rotation driving source and the shift in the partition separating the wire winding part into a plurality of sections is performed by the second rotation driving source.

With the technical art like this, as the shift of the nozzle in the partition for partitioning the winding part of the wind-up tool, the shift of the nozzle in the partition being shorter than that in the winding part, is done by the second rotation driving source, the shift of the nozzle in flange parts, i.e. partitions, of a bobbin having a plurality of winding section can be done with accuracy.

It is also desirable in the invention to constitute the apparatus so that, the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

It is also an effective means of the invention to constitute an apparatus for winding wire around the outer peripheries of a plurality of rotating wind-up tools of which the peripheries are parallel to their axes of rotation so that the apparatus comprises;

a plurality of rotatable wind-up tool holders for attaching each wind-up tools, a plurality of rotation driving sources each of which is connected to each wind-up tool holder for rotating each wind-up tool, and a rotation control means for controlling the rotation driving sources for rotating the wind-up tools in synchronism with each other, and further a plurality of back-and-forth direction control means for moving each of a plurality of nozzle means, by the medium of which the wires are supplied to the wind-up tools, in the direction of the rotation axis of the wind-up tool holder corresponding to the wire winding motion.

With the technical art like this, as the wire winding is done without control means of position in the vertical and right-and-left direction, the apparatus is simple and compact.

It is also an effective means of the invention to constitute the apparatus for winding wire so that, the rotation driving source for moving the nozzle means consists of a first and a second rotation driving source for moving the nozzle means in the direction of the rotation axis of the wind-up tool during wire winding action, the moved distance of the nozzle means by unit rotation of the second rotation driving source is smaller than that of the first rotation driving source, and the initial position of the nozzle means is adjusted by the second rotation driving source.

With the technical art like this, the fine adjusting of the positions of the nozzles is possible by the second rotation driving sources, and the initial positions of the nozzles can be set accurately even in the case of thin wires, as mentioned before.

It is also an effective means of the invention to constitute an apparatus for winding wire so that, the rotation driving source for moving the nozzle means consists of a first and a second rotation driving source for moving the nozzle means in the direction of the rotation axis of the wind-up tool during wire winding action, the moved distance of the nozzle means by unit rotation of the second rotation driving source is smaller than that of the first rotation driving source, and the shift of the nozzle means in the wire winding part of the wind-up tool is performed by the first rotation driving source and the shift in the partition separating the wire winding part into a plurality of sections is performed by the second rotation driving source.

With the technical art like this, as the shift of the nozzle in the partition for partitioning the winding part of the wind-up tool, the shift of the nozzle in the partition being shorter than that in the winding part, is done by the second rotation driving source, the shift of the nozzle in flange parts, i.e. partitions, of a bobbin having a plurality of winding section can be done with accuracy.

It is desirable in the second invention to constitute the apparatus for winding wire so that, the rotation driving source is rotated by control pulses, feedback pulses with the same frequency as the control pulses are sent out from the rotation driving source, and the number of rotation of the rotation driving source is detected by counting the number of the feedback pulses which is the same as that of the control pulses.

It is also an effective means of the invention to constitute the apparatus so that, it comprises; intermediate holders capable of detaching-and-attaching the wind-up tools, the wind-up tool holders capable of detaching-and-attaching the intermediate holders, and release means for releasing the holding forces of the wind-up tool holders for holding the intermediate holders; and the wind-up bodies and intermediate holders are capable of being detached/attached from or to the wind-up tool holders.

With the technical art like this, as the wind-up tool is capable of being detached and attached together with the intermediate holder, various kind of wind-up tool can be adapted by changing the intermediate holder corresponding to various size of wind-up tool.

The present invention also provides a method of winding wire around the outer peripheries of a plurality of stationary wind-up tools of which the peripheries are parallel to their axes, wherein wire is supplied through the trough hole of each of a plurality of spinning bodies each of which is located with its rotation axis coinciding with the axis of each wind-up tool facing each spinning body, an individual rotation driving source for supplying the wire is provided for each spinning body, and each rotation driving source rotates in synchronism with each other to wind the wire around each wind-up tool.

By the art like this, the wind-up tool is fixed, and the wire is wound around the stationary wind-up tool by rotating the wire supply part located facing the wind-up tool. A rotation driving source is provided for each of the wire supply parts, and the wire winding is performed by rotating the plurality of rotation driving sources in synchronism each other.

The wind-up tool may be a bobbin or a core other than bobbin, the wire being wound around the core to be formed into a coil which is removed from the core after the winding.

Further, by the art like this, as a rotation driving source is provided for each wire supply part unlike the case the wind-up tools are driven by a driving source using a belt, it is possible to engage the wire without the failure caused by the deviation of position of a nozzle and bobbin terminal, and further, as a belt transmission mechanism is not used for driving a plurality of spindles by a driving source, there occurs no problem of slacken belt, and a wire winding method with superior responsivity to command signals can be obtained.

It is also an effective means of the invention to constitute the apparatus so that, the wire is supplied to the wind-up tool by way of a nozzle, and the initial position of the wire before winding is set by moving the nozzle back-and-forth, or so that the nozzle is moved back-and-forth corresponding to the wire winding motion to be adjusted to the proper position.

With the technical art like this, as the wire winding is done without control means of position in the vertical and right-and-left direction, the apparatus is simple and compact.

It is also an effective means of the invention to constitute the apparatus so that, the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

The present invention also provides an apparatus for winding wire around the outer peripheries of a plurality of stationary wind-up tools of which the peripheries are parallel to their axes, wherein the apparatus comprises; a plurality of wind-up tools, nozzle parts for supplying wires, rotating bodies rotatable about the same axes as those of the wind-up tools, each rotating body being provided with each nozzle part and located facing each wind-up tool, and rotation driving sources each of which is provided for rotating each rotating body; and the wire winding around each stationary wind-up tool is performed by rotating each rotation driving source in synchronism with each other.

By the art like this, the wind-up tool is fixed, and the wire is wound around the stationary wind-up tool by rotating the wire supply part located facing the wind-up tool. A rotation driving source is provided for each of the wire supply parts, and the wire winding is performed by rotating the plurality of rotation driving sources in synchronism each other, as mentioned before.

The wind-up tool may be a bobbin or a core other than bobbin, the wire being wound around the core to be formed into a coil which is removed from the core after the winding.

Further, by the art like this, as a rotation driving source is provided for each wire supply part unlike the case the wind-up tools are driven by a driving source using a belt, it is possible to engage the wire without the failure caused by the deviation of position of the nozzle and bobbin terminal, and further, as a belt transmission mechanism is not used for driving a plurality of spindles by a driving source, there occurs no problem of slacken belt, and a wire winding apparatus with superior responsivity to command signals can be obtained.

It is a desirable means to constitute the apparatus so that it is provided with rotation driving sources for moving each spinning body having a nozzle part back-and-forth in the direction of the axis of the spinning body to adjust the position of each nozzle part to the proper position.

With the technical art like this, as the wire winding is done without control means of position in the vertical and right-and-left direction, the apparatus is simple and compact.

It is also an effective means of the invention to constitute the apparatus so that, the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
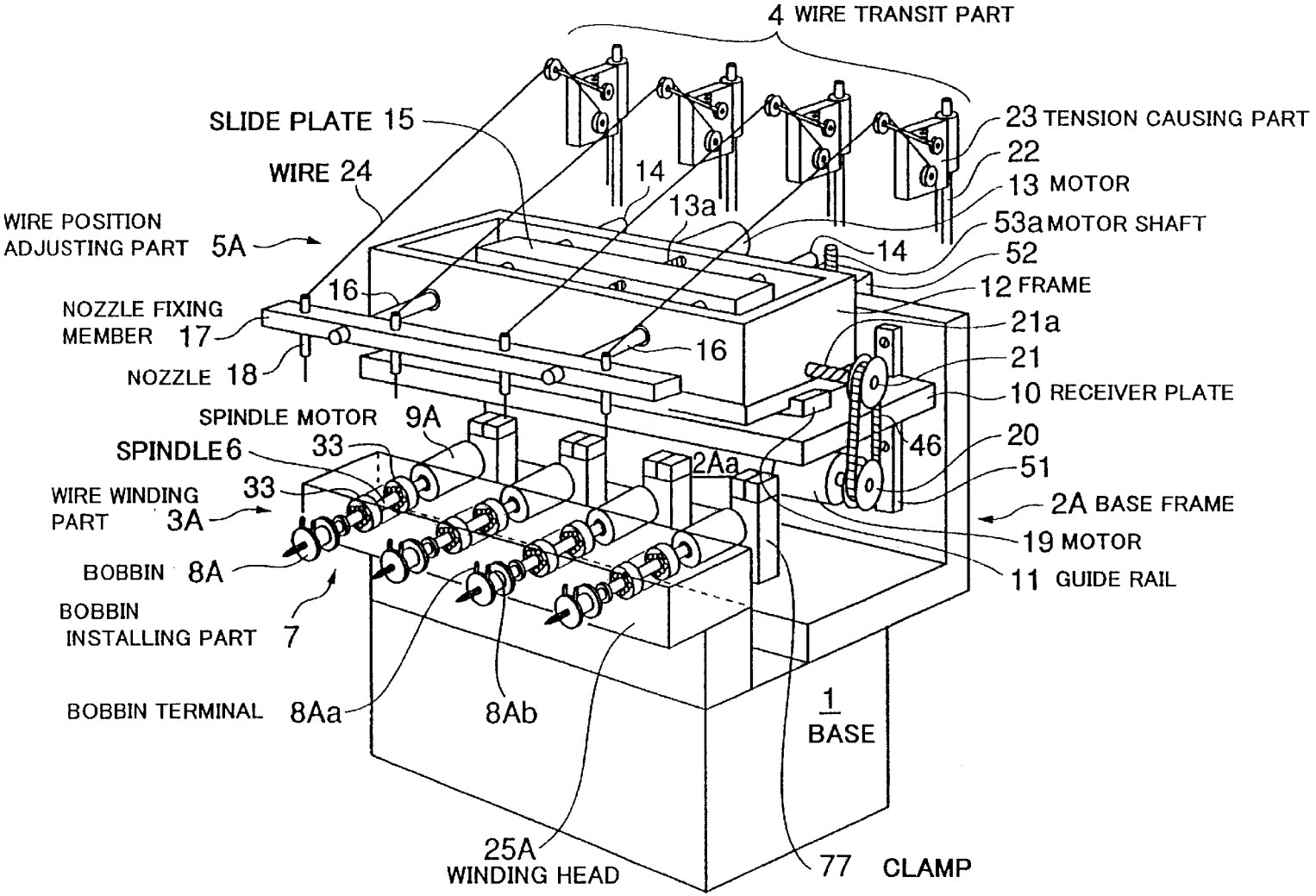
FIG. 1 is a perspective view of a wire winding apparatus of the first embodiment according to the present invention.
Figure 2:
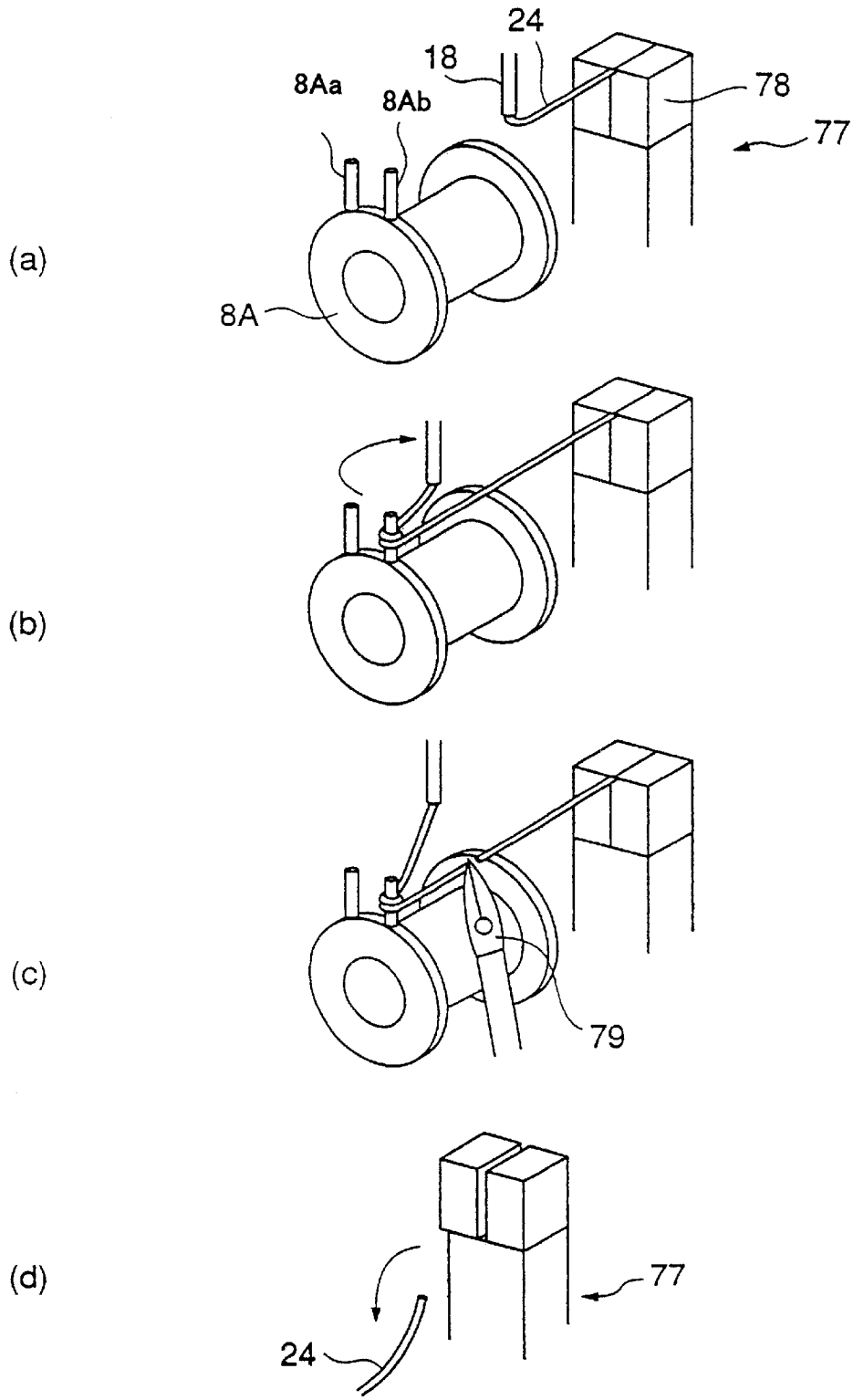
FIG. 2 is a perspective view for explaining the method of engaging the wire to the terminal of a bobbin in the first embodiment.
Figure 5:
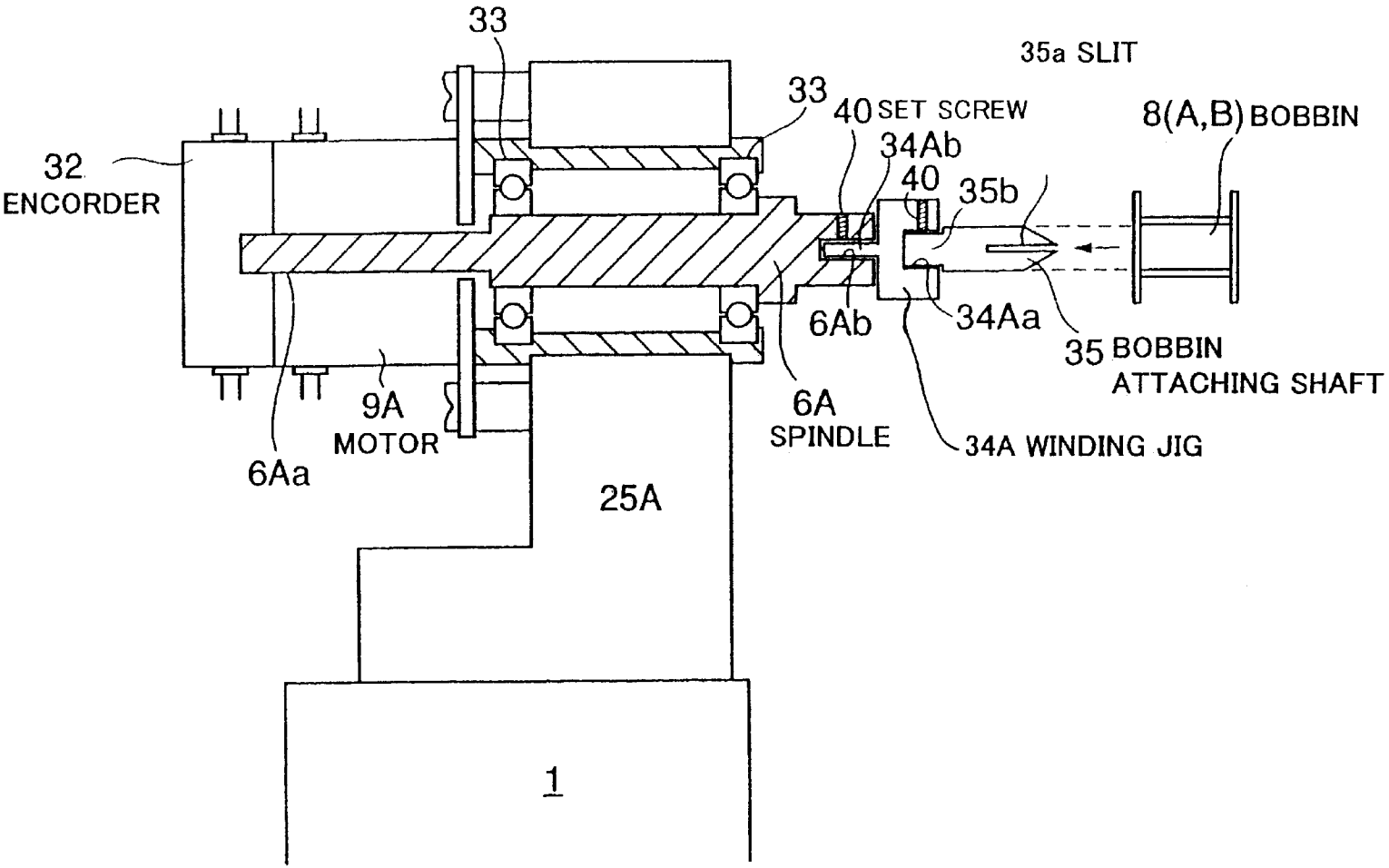
FIG. 5 is a section view showing the structure of an embodiment of bobbin installing part in the first and second embodiment according to the present invention.
Figure 6:
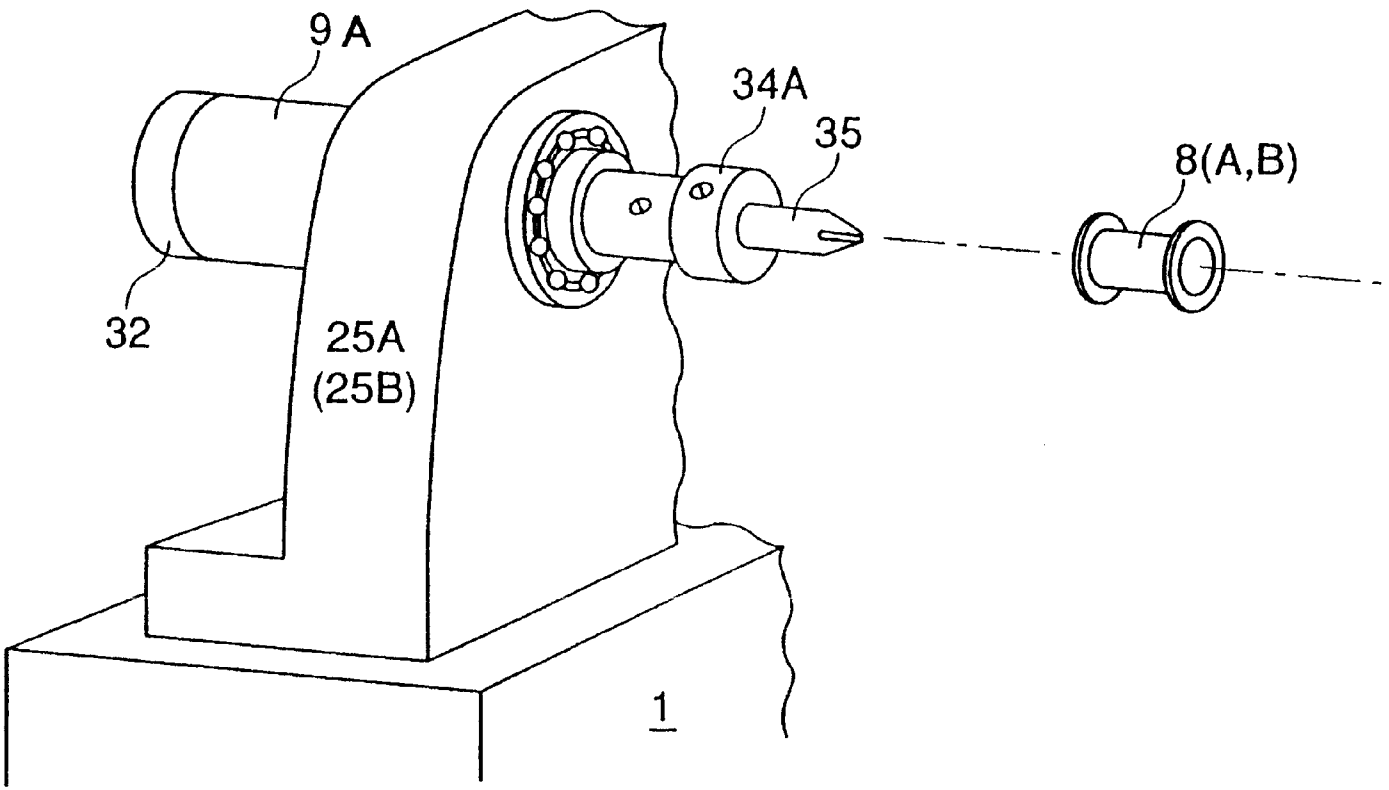
FIG. 6 is a perspective view of FIG. 5.
Figure 7:
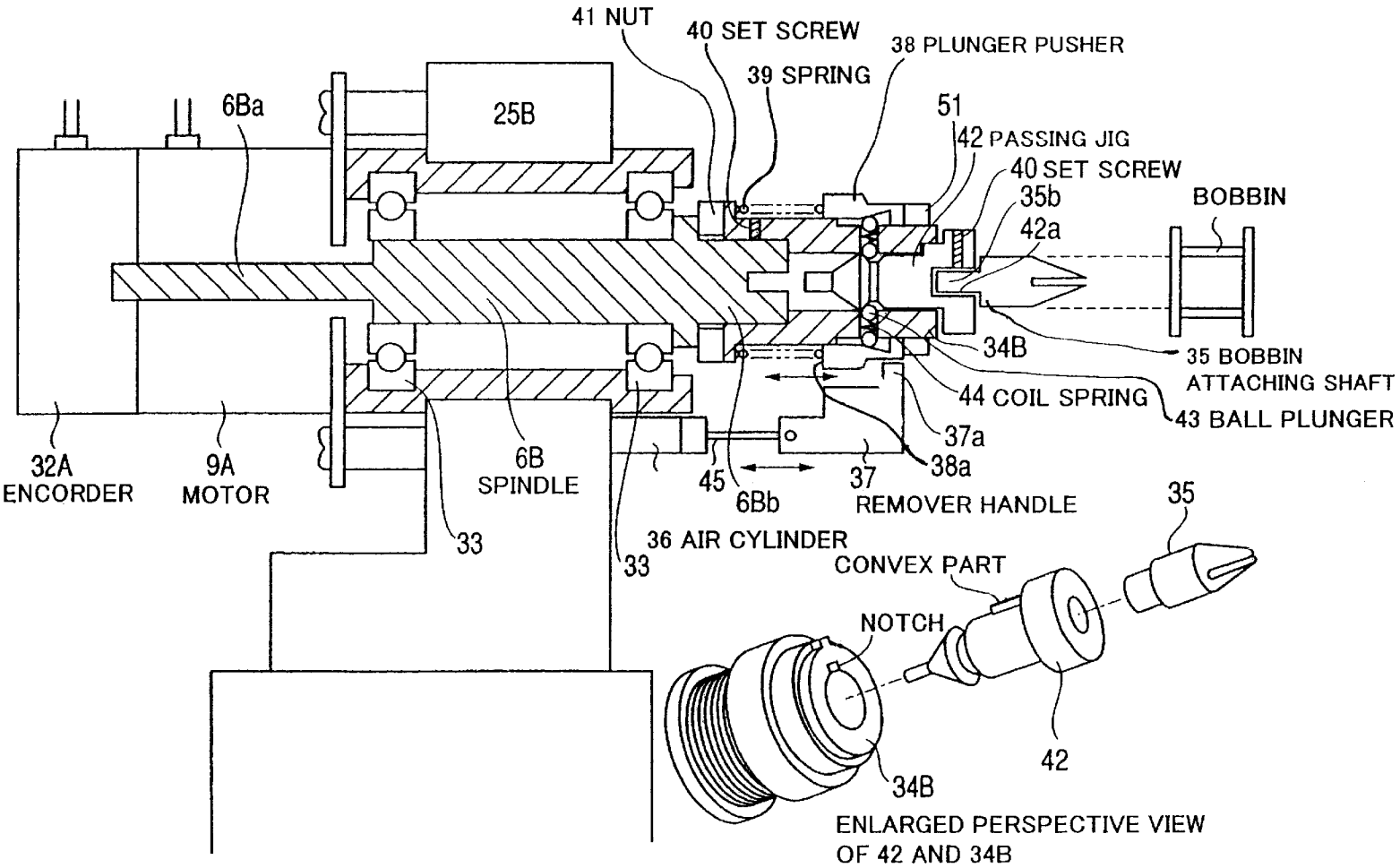
FIG. 7 is a section view showing another embodiment of bobbin installing part in the first and second embodiment according to the present invention.
Figure 9:
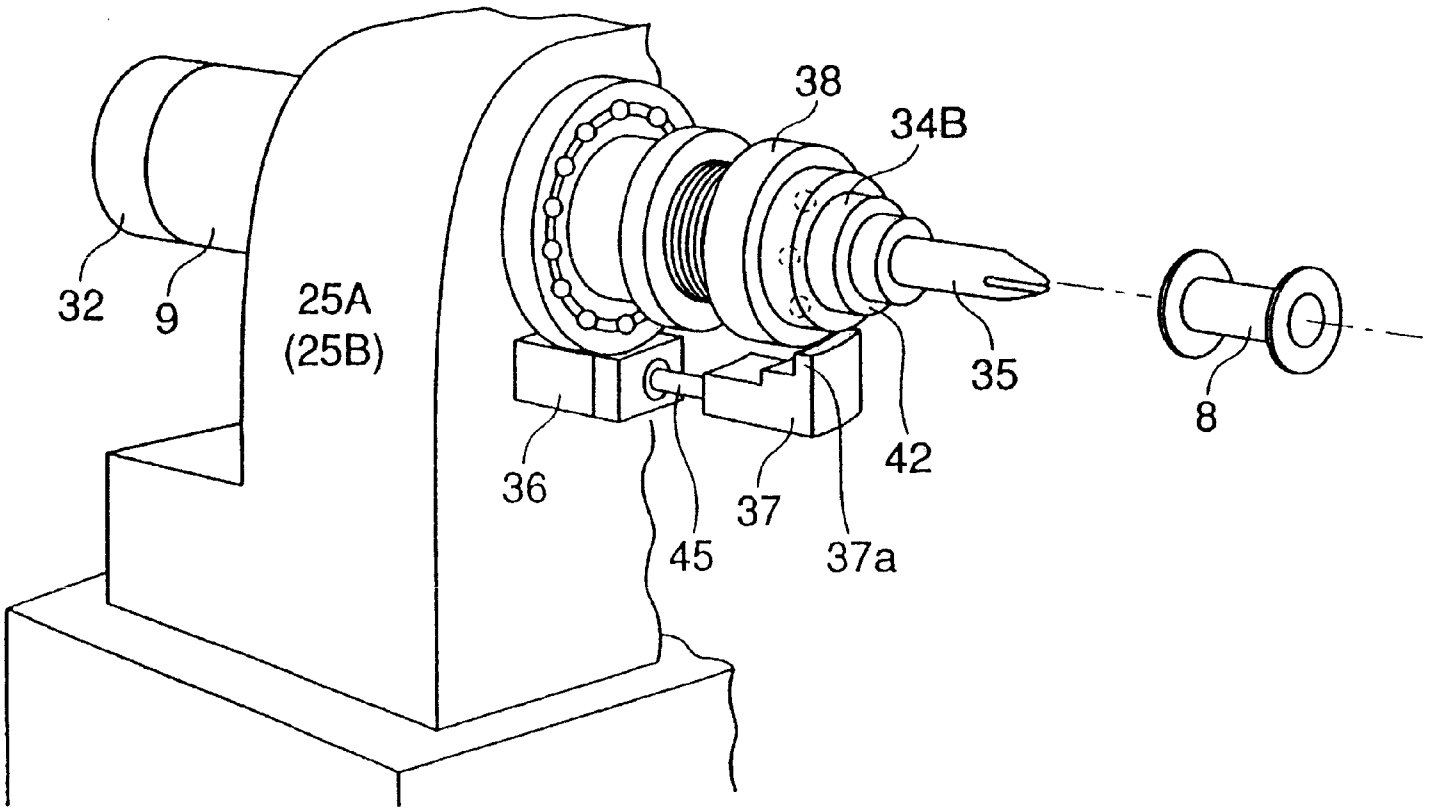
FIG. 9 is a perspective view of FIG. 7.
Figure 13:
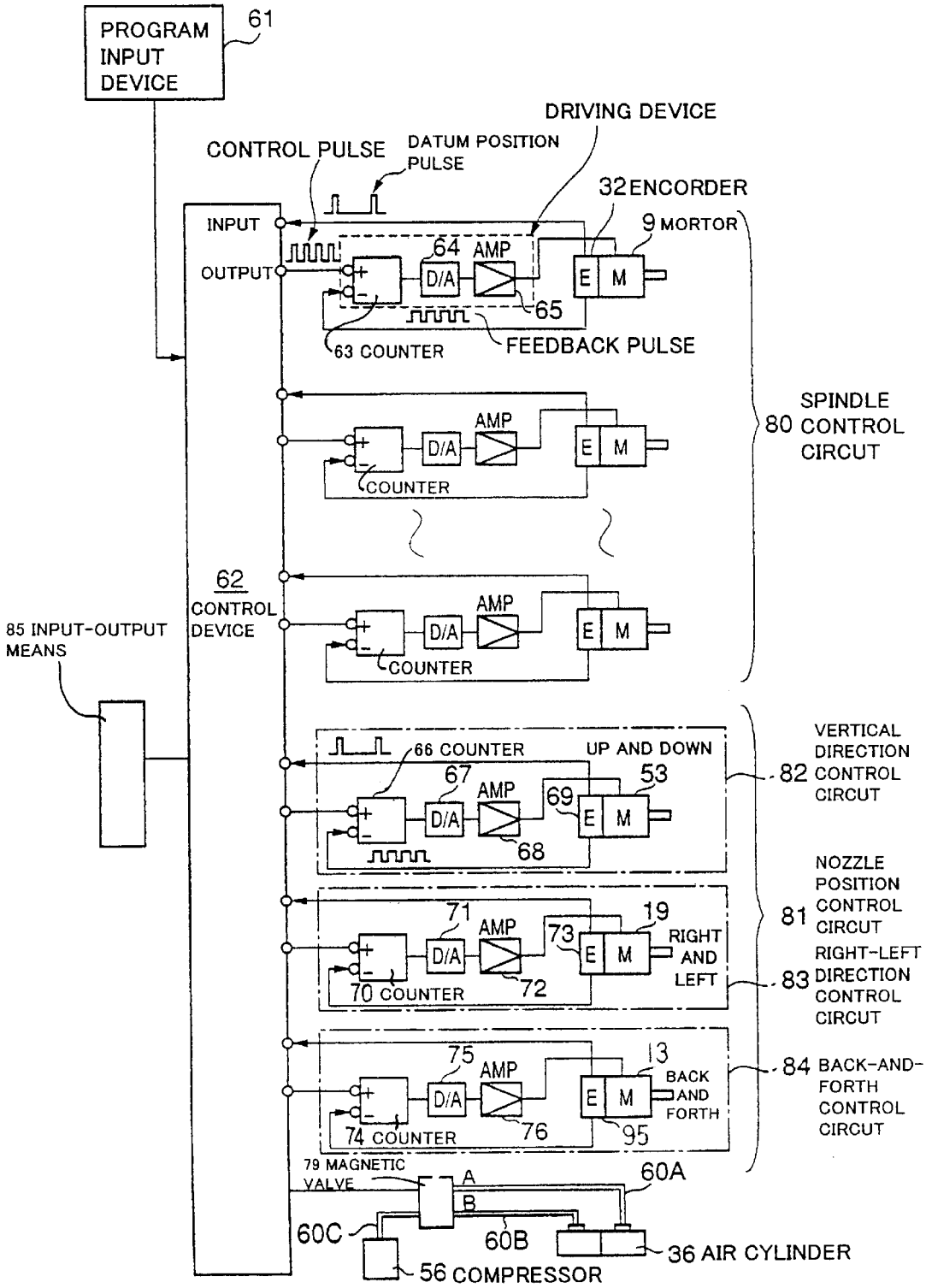
FIG. 13 is the electric block diagram of a control device in the first embodiment.

FIG. 1 is a perspective view of a wire winding apparatus of the first embodiment according to the present invention, FIG. 2 is a perspective view for explaining the method of engaging the wire to the terminal of a bobbin in the first embodiment, FIG. 5 is a section view showing the structure of an embodiment of bobbin installing part, FIG. 6 is a perspective view of FIG. 5, FIG. 7 is a section view showing another embodiment of bobbin installing part, FIG. 9 is a perspective view of FIG. 7, and FIG. 13 is the electric block diagram of a control device in the first embodiment.

In FIG. 1, on a base 1 is fixed a base frame 2A which has L-shaped section. A winding head 25A for winding up wire is installed in the front side of the base frame 2A.

Each of a plurality of spindles 6 having bobbin installing part 7 on its one end side is supported in the winding head 25A for rotation by the medium of springs and the other end side of the spindle is inserted into the spindle motor 9A so as to act as the rotation shaft of the motor 9A.

A plurality of wire winding parts 3A, each consisting of the spindle 6, bearings 33, 33, and spindle motor 9A, are installed in the winding head 25A.

Clamps 77 for engaging wires 24 to the bobbin terminals 8Ab (FIG. 2) are mounted facing the rear end of the spindle motor 9 on the base frame 2A.

On the front side face 2Aa of the upright frame of the base frame 2A are fixed a right and a left guide rail 51, 51 (left rail is not shown for convenience sake), and a receiver plate 10 is mounted for slide in the direction of up and down guided by the guide rails 51, 51.

Figure 17:
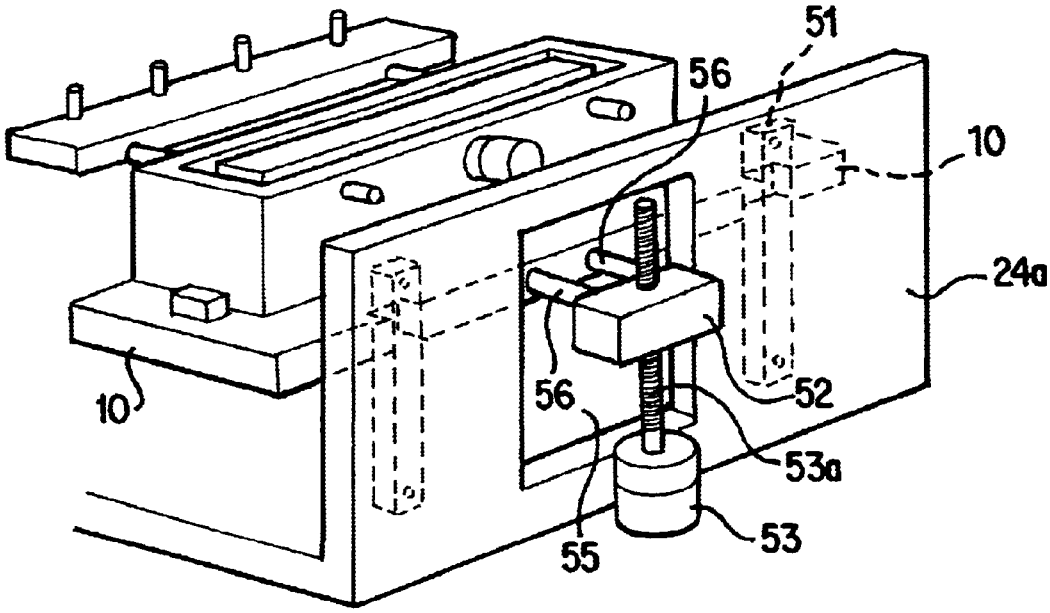
FIG. 17 is a rear perspective view of the apparatus of FIG. 1.

The receiver plate 10 can be moved up and down in FIG. 1 driven by a motor 53 shown in FIG. 17, for a hole 55 is provided on the face 2Aa through which a connecting bar 56 is connected to a block 52 underneath which is mounted the motor 53, and the rotation shaft 53*a*, with a guide screw cut on it, of the motor 53 passes through the guide screw hole in the block 52.

On the receiver plate 10 is provided a guide rail 11, and the a frame 12 is mounted for slide in the direction of right-and-left.

A rotation shaft 21*a* on which a guide screw is cut passes through the frame 12, a pulley 21 is fixed at the end of the rotation shaft 21*a,* a motor 19 is mounted on the underside of the receiver plate 10, a pulley 20 is fixed to the rotation shaft of the motor 19, and a belt 46 is looped over the pulley 20 and pulley 21, so the frame is moved toward right-and-left as the motor 19 rotates.

On the rear side of the frame 12 is mounted a motor 13, and the height of the base frame 2A is limited so that the motor 13 does not interfere with the base frame 2A when the frame moves up and down.

A slide plate 15 is provided in the frame 12, guide bars 14, 14 are fixed on the rear side and bars 16, 16 on the front side of the slide plate 15. A nozzle fixing member 17 is fixed to the end sides of the bars 16, 16 in the front outside of the frame 12. As a guide screw is cut on the rotation shaft of the motor 13 and the threaded shaft passes through the guide screw hole in the slide plate 15 to move the slide plate back-and-forth as the motor 13 rotates, which makes possible the shift of nozzles 18 in back-and-forth direction.

Accordingly, the horizontal longitudinal, horizontal lateral, and vertical positions of the nozzles 18 can be set.

The wires 24 are supplied by way of a wire transit part 14 provided in the rear of the base frame 2A. The wire transit part 14 consists of pillars 22 and tension causing parts 23 for causing tension to be generated in the wires. A spool 31 corresponding to each wire is provided, as shown in FIG. 4, in the rear of the base 1.

Figure 4:
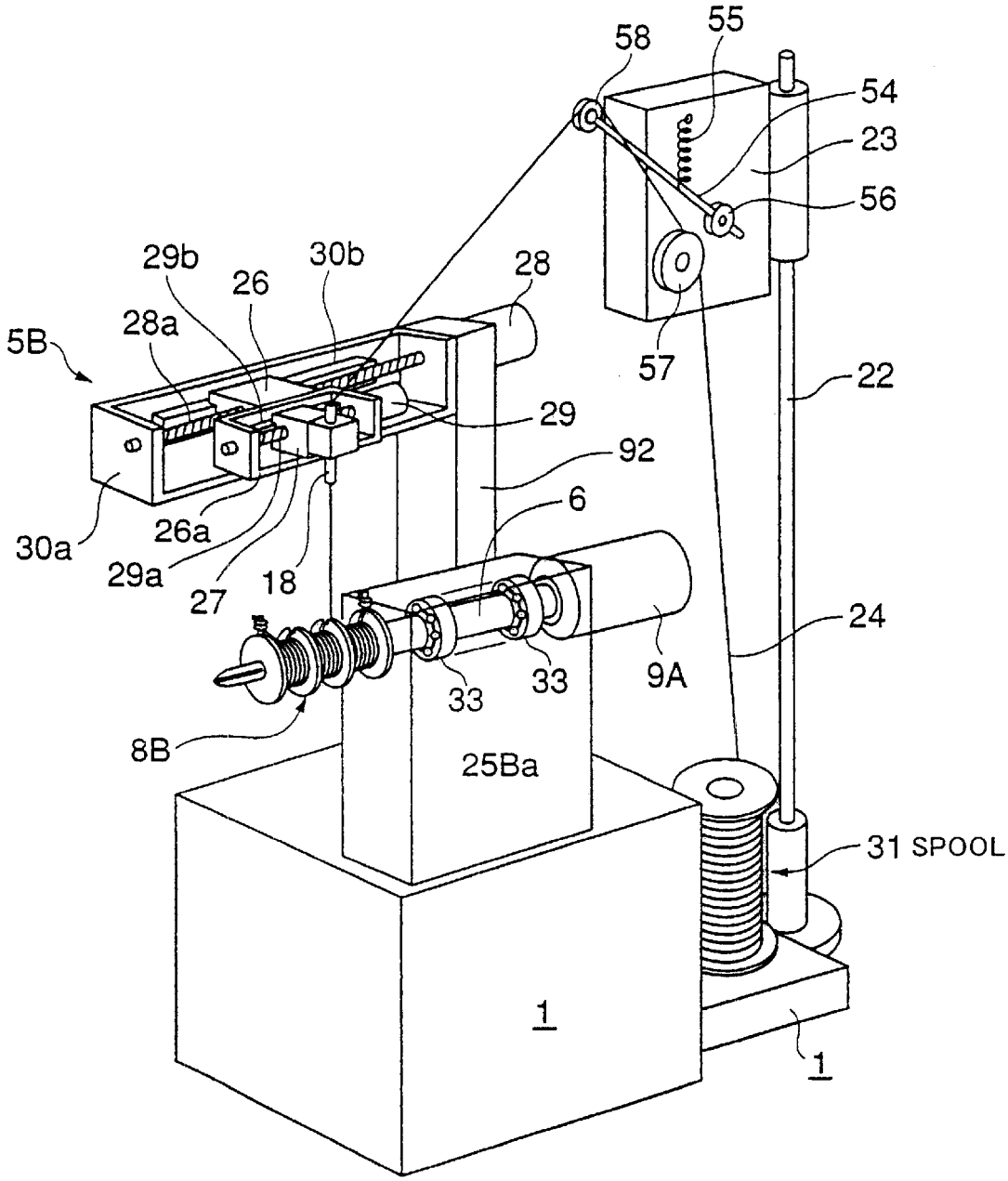
FIG. 4 is a perspective view showing the wire supply and positioning mechanism of the second embodiment according to the present invention.

In FIG. 4, each tension causing part 23 consists of a transit roller 57, transit arm 54 provided with a transit roller 58 at the tip and supported rotatable about a shaft 56, and a coil spring for exerting force in the clockwise direction. In the operation of the apparatus, magnetic brake force is applied to the transit roller 57 to exert proper friction thereon.

Next, an embodiment of the bobbin installing part according to the first embodiment will be explained with reference to FIG. 5. In the drawing, the motor 9A with an encorder 32 is attached to the winding head 25A, and an end part 6Aa of the spindle 6A supported for rotation by bearings 33, 33 is inserted into the motor 9A in the center.

The end part 6Aa of the spindle 6A is, for example, shaped to have an oval section, and the oval-shaped part engages with the concave part of the motor side.

A hole 6Ab is machined on the right end of the spindle 6A, the smaller diameter part 34Ab of a winding jig 34A is inserted into the hole 6Ab to be fixed by a set screw 40. A hole 34Aa is machined in the center of the larger diameter part of the winding jig 34A, and the rear end side 35*b* of a bobbin attaching shaft 35 is inserted into the hole 34Aa to be fixed by a set screw 40. A slit 35*a* is provided in the right end side of the bobbin attaching shaft 35 to cause friction between the shaft 35 and the bobbin 8A in order to hold the bobbin 8A on the shaft 35 so that the bobbin attached to the shaft 35 does not rotate and smooth winding is performed.

Next, another embodiment of the bobbin attaching part according to the first embodiment will be explained with reference to FIG. 7. In the drawing, a motor 9A with an encorder 32A is attached to the winding head 25B, and an end part 6Ba of the spindle 6B supported for rotation by bearings 33, 33 is inserted into the motor 9A in the center.

The end part 6ba of the spindle 6B is, for example, shaped to have an oval section, and the oval-shaped part engages with the concave part of the motor side.

A screw is cut on the right end part 6Bb of the spindle 6B, a nut 41 is screwed in and also a winding jig 34B is screwed in.

Figure 8:
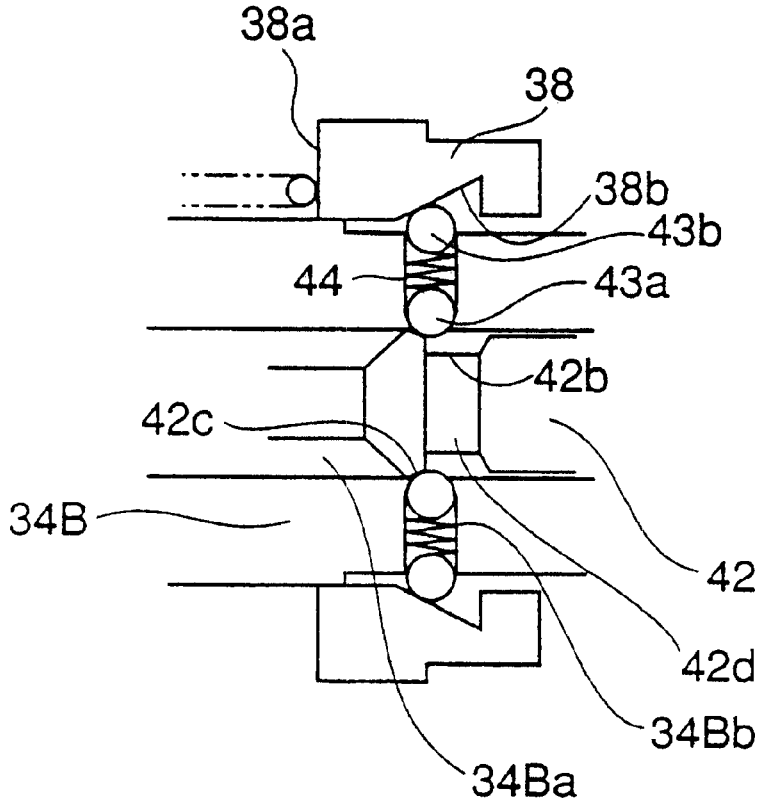
FIG. 8 is a partially enlarged detail of FIG. 7.

The winding jig 34B is, as shown in FIG. 8, shaped like a cylinder having inner hollow space 34Ba. Six through holes 34Bb penetrate the cylinder wall radially as shown in FIG. 8, and in the through holes are inserted ball plungers 43*a,* 43*b,* and a coil springs 44. Each of the trough holes is shaped so that it is smaller in diameter at the inner hollow space side than at the outer periphery side of the cylindrical winding jig 34B in order to prevent the dropping of the ball plungers 43A into the inner hollow space 34Ba.

A plunger pusher 38 is put on the outer periphery of the winding jig 34B slidable in back-and-forth direction(right-and-left direction in FIG. 7 and FIG. 8). A spring 39 is inserted between the flange part at the rear end of the winding jig 34B and the rear end face 38*a* of the plunger pusher 38, the plunger pusher 38 is stopped by a nut 51 screwed on the forward end part of the winding jig 34B, and the spring 39 exerts force on the rear end face 38*a* of the plunger pusher 38 in the forward direction. The plunger pusher 38 has a cone-shaped cam face 38*b* which tapers in the backward direction. Accordingly, when the plunger pusher 38 is in the state being stopped by the nut 51, the pushing force of the plunger ball 43*a* toward the inner hollow space is large, and when the plunger pusher 38 is moved toward left in FIG. 7, the pushing force of the plunger ball 43*a* toward the inner hollow space is decreased.

A passing jig 42 is inserted in the inner hollow space 34Ba, a groove 42*d* is machined on the inserted part of the passing jig. When the passing jig 42 is inserted, the ball plunger 43*a* contacts on the bottom and/or inclined side face of the groove 42*d* to fix the passing jig 42 concerning the axial direction. The passing jig 42 is fixed concerning the circumferential direction by the fitting of the convex part provided on the passing jig with the notch provided in the winding jig 34B. A hole 42*a* is machined in the center of the larger diameter part of the passing jig 42, and rear end part 35*b* of the bobbin attaching shaft 35 is inserted into the hole 42*a* to be fixed by a set screw 40. The right end part of the bobbin attaching shaft 35 tapers in a point, and a slit is machined to cause friction between the shaft 35 and the bobbin 8A in order to hold the bobbin 8A on the shaft 35 so that the bobbin attached to the shaft 35 does not rotate and smooth winding is performed.

In FIG. 7, an air cylinder 36 is provided below the bearings 33 of the winding head 25B, a cylinder shaft 45 protrudes in the forward direction from the air cylinder 36, and a remover handle 37 is fixed to the end of the cylinder shaft 45. The remover handle 37 has at the forward end an upright wall part 37*a* which can engages the flange part 38*a* of the plunger pusher 38. Accordingly, when the cylinder shaft 45 is moved leftward by the operation of the air cylinder 36, the upright wall part 37*a* of the remover handle 37 engages the flange part 38*a* of the plunger pusher 38 to move it leftward. When the plunger pusher is moved leftward, the pushing force of the ball plungers 43*a* decrease, and the passing jig 42 can be removed from the winding jig 34B.

Next, an electric block diagram of the control device of the embodiment will be explained with reference to FIG. 13. In the drawing, an electric control device 62 having a CPU inside it and an interface on each of input and output side, is controlled by the control program of a program input device 61.

The electric control device 62 is so configured so that, a spindle control circuit 80 for individually controlling a plurality of spindles is connected with a nozzle position control circuit 81 for controlling the position of nozzles for supplying wire, the spindle control circuit 80 and nozzle position control circuit 81 consists of a plurality of circuits respectively, and these circuits can be controlled in synchronism with each other respectively.

The spindle control circuit 80 has an individual circuit for each of the individual spindles, each circuit controls the motors 9 of which each motor shaft is part of each spindle, each motor having a directly-coupled encorder 32. The motor 9 is connected to the output terminal of the electric control device 62 by way of a counter 63, a D/A converter 64, and an amplifier 65, starts to rotate by the control pulses of the electric control device 62, and stops the rotation when the number of the feedback pulses sent forth by the encorder 32 coincides with that of the control pulses inputted.

The encorder 32 is configured so that it sends forth a datum position pulse when the rotation shaft of the motor 9 comes to a predetermined position in a rotation.

Accordingly, the electric control device 62 sends forth the control pulses to allow the motor 9 to rotate until the datum position pulse comes in, and when it stops to send forth the control pulses, the spindle is set on the initial rotation position owing to the fact that the motor is automatically stopped by the feedback pulses. With this positioning, the wires 24 are engaged to the terminals of the bobbins 8, and after that the motors 9 are rotated for winding the wires around the bobbins 8.

The nozzle position control circuit 81 is a circuit for controlling the position of the nozzle fixing member 17 shown in FIG. 1. The position of the nozzle fixing member 17 in vertical, right-and-left, and back-and-forth direction, accordingly the positions of the nozzles, is controlled by the individual motor. The positions of the nozzles are required to be moved also in maintenance work other than when winding is carried out.

The nozzle position control circuit 81 is of the same configuration as the spindle control circuit 80.

A vertical direction control circuit 82 for controlling the vertical position of the spindles is to control the motor 53 of which the motor shaft is connected to the frame 12, the motor having a directly-coupled encorder 69. The motor 53 is connected to the output terminal of the electric control device 62 by way of a counter 66, a D/A converter 67, and an amplifier 68, starts to rotate by the control pulse of the electric control device 62, and stops the rotation when the number of the feedback pulses sent forth by the encorder 69 coincides with the number of the control pulses inputted.

The encorder 69 is configured so that it sends forth a datum position pulse when the rotation shaft of the motor 53 comes to a predetermined position in a rotation.

Accordingly, the electric control device 62 sends forth the control pulse to allow the motor 53 to rotate until the datum position pulse comes in, and when it stops to send forth the control pulse, the frame 12 is set on the initial rotation position owing to the fact that the motor is automatically stopped by the feedback pulses.

Similarly, a right-and-left direction control circuit 83 is to control the motor 19 of which the motor shaft is connected to the frame 12 by the medium of belt and pulley, the motor having a directly-coupled encorder 73. The motor 19 is connected to the output terminal of the electric control device 62 by way of a counter 70, a D/A converter 71, and an amplifier 72, starts to rotate by the control pulses of the electric control device 62, and stops the rotation when the number of the feedback pulse sent forth by the encorder 73 coincides with the number of the control pulses inputted.

Similarly, a back-and-forth direction control circuit 95 is to control the motor 13 which is mounted on the frame 12 and of which the motor shaft is connected with the slide plate 15 by the guide screw of the motor shaft, the motor 13 having a directly-coupled encorder 95. The motor 13 is connected to the output terminal of the electric control device 62 by way of a counter 74, a D/A converter 75, and an amplifier 76, starts to rotate by the control pulses of the electric control device 62, and stops the rotation when the number of the feedback pulses sent forth by the encorder 95 coincides with the number of the control pulses inputted.

Each of these encorders 69, 73, and 95 is configured so that it sends forth a datum position pulse when the rotation shaft of each of the motors 53, 19, and 13 comes to a predetermined position in a rotation.

Accordingly, the electric control device 62 sends forth control pulses to allow each of the motors 53, 19, and 13 to rotate until each datum position pulse comes in, and when it stops to send forth the control pulses, the nozzle fixing member 17 is set on the initial position owing to the fact that each of the motors is automatically stopped by the feedback pulses of which the number of pulses coincides with that of the control pulses.

With this positioning, the wires 24 are engaged to the terminals of the bobbins 8, and after that the motors 9 are rotated for winding the wires around the bobbins 8.

A signal wire of a magnetic valve 79 for switching the air supplied from an air compressor 59 to the air cylinder 36 through a piping 60 is connected to the output terminal of the electric control device 62.

Next, the operation of the winding apparatus of the first embodiment configured as described will be explained.

As shown in FIG. 4, the wire 24 from the spool 31 is stringed over the transit roller 57 and 58 for causing tension by the medium of magnetic braking, and the tip of the wire 24 is allowed to hang down from the nozzle 18 as shown in FIG. 1.

Then, an input-output means 85 is manipulated to operate the nozzle position control circuit 81 in the state each bobbin 8 is attached to the bobbin attaching shaft 35 of each spindle.

Hereupon, the vertical direction control circuit 82 starts operation to set the vertical position of the nozzles, then the right-and-left direction control circuit 83 starts operation to set the right-and-left positions of the nozzles, and after that the back-and-forth direction control circuit 84 starts operation to set the back-and-forth position of the nozzles.

The spindle control circuit 80 starts operation in synchronism with the operation start of the nozzle position control circuit 81 to set each bobbin 8 on the predetermined angle position. With this condition, the tip of each wire 24 is pinched in the pinching part 78 of each clamp 77, then each nozzle 18 turns around the terminal 8*b* of each bobbin 8 to engage the wire 24 to the terminal 8*b*. Then each wire 24 is cut with a cutter 79 in between the terminal 8*b* and pinching part 78. The remainder of each wire 24 held by each clamp is discharged by opening the pinching part 78.

Next, when the input-output means 85 is manipulated to operate each spindle motor 9A, each wire 24 is wound around each bobbin 8A. In synchronism with the start of winding, the distance from the tip of each nozzle 18 to the outer periphery of each wire 24 wound around each bobbin 8 is controlled to be at the predetermined position by the vertical direction control circuit 82, and the position of each nozzle 18 is controlled by the right-and-left direction control circuit 83 corresponding to each wound layer of wire and by the back-and-forth direction control circuit 84 corresponding to the number of turns.

As the positions of the nozzles 18 are controlled by the vertical direction control circuit 82, the right-and-left direction control circuit 83, and back-and-forth direction control circuit 84, the positions of nozzles from the outer periphery of the winding wires are controlled with good accuracy even when fine wires of diameter of about 0.02 mm are wound around bobbins.

Figure 3:
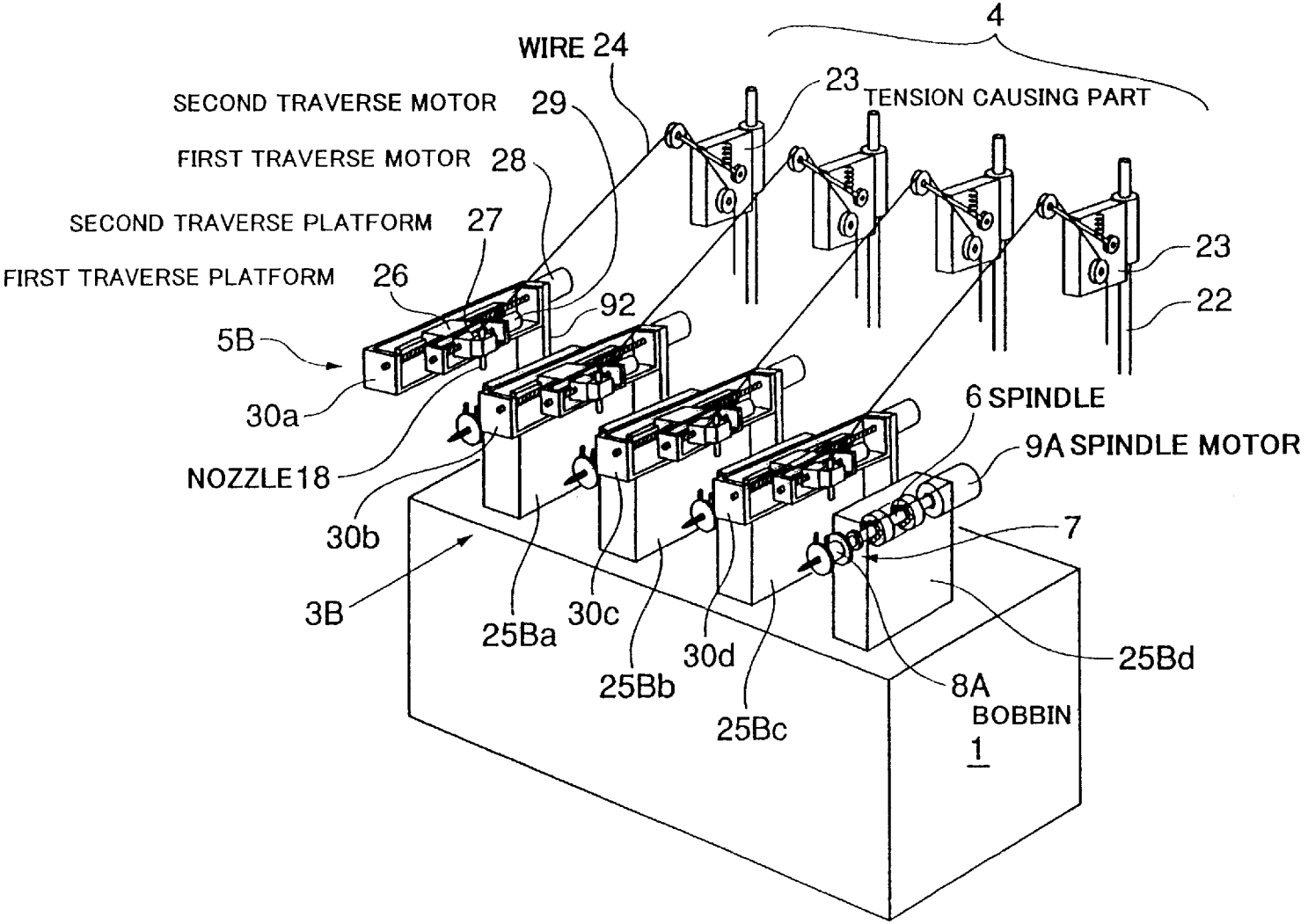
FIG. 3 is a perspective view of a wire winding apparatus of the second embodiment according to the present invention.
Figure 14:
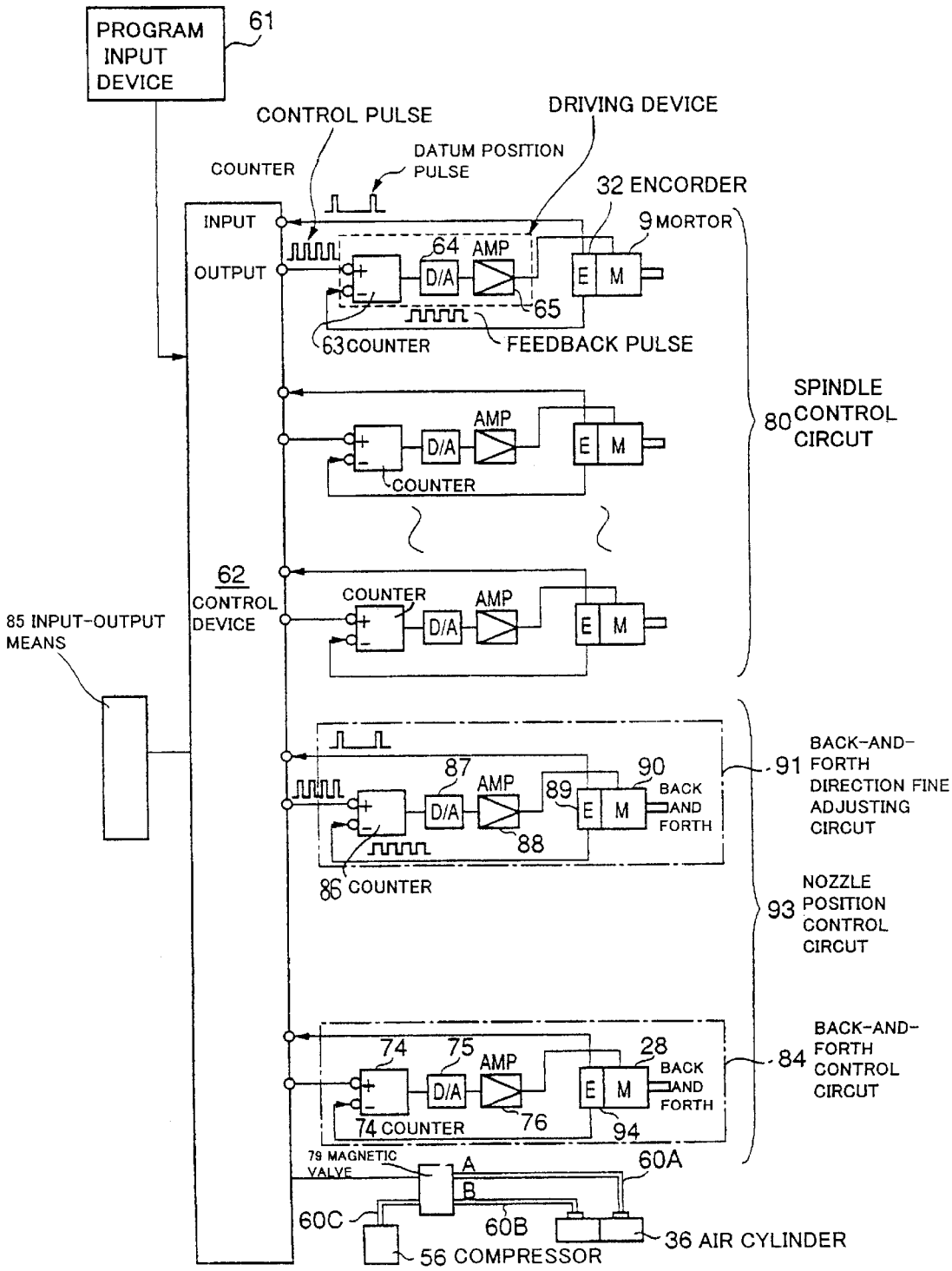
FIG. 14 is the electric block diagram of a control device in the second embodiment.

FIG. 3 is a perspective view of wire winding apparatus of the second embodiment according to the present invention, FIG. 4 is a perspective view showing the wire supply and positioning mechanism of the second embodiment, and FIG. 14 is the electric block diagram of a control device in the second embodiment.

The wire winding apparatus of the second embodiment according to the present invention will be explained with reference to FIG. 3.

The point of difference from the first embodiment is that, unlike the first embodiment in which the position of each nozzle assigned to each spindle is adjusted in the vertical, right-and-left, and back-and-forth direction by three motors, in the second embodiment, vertical and right-and-left direction control circuits are omitted, and a back-and-forth direction control circuit and a back-and-forth direction fine adjusting circuit are provided in the second embodiment.

As shown in FIG. 4, a wire transit part 4 explained in FIG. 1 is provided in the rear of a base 1, and winding heads 25B(a~d) are mounted on the base 1, on each winding head 25B being mounted a spindle, a spindle motor, and a bobbin which are explained in the explanation of FIG. 1 and shown in FIG. 5~FIG. 9.

Nozzle control parts 30(four nozzle control parts in case shown in figure) fixed to pillars 92 provided on winding heads 25(A~d) of a wire winding part 3B constitute wire tip position adjusting parts 5B.

As the construction of the nozzle control parts 30(a~d) are the same, the nozzle control part 30*a* in FIG. 4 will be explained. A first traverse platform 26 is provided in the nozzle control part 30*a* for slide in the longitudinal direction of a guide rail 30*b* guided by the same. A rotation shaft 28*a* connected with the rotation shaft of a first traverse motor 28 mounted on the pillar 92 has a guide screw cut on it, the rotation shaft 28*a* passes through a guide screw hole of the first traverse platform 26, so the platform 26 can be slid in the longitudinal direction of the rotation shaft 28*a* as the motor 28 rotates.

A second traverse platform 27 with a nozzle 18 fixed to it is provided in the frame part 26*a* of the first traverse platform 26 for slide in the longitudinal direction of a guide rail 29*b* guided by the same.

A second traverse motor 29 is attached to the frame part of the first traverse platform on the right end face. A rotation shaft 29*a* connected with the rotation shaft of the second traverse motor 29 has a guide screw of which the pitch is smaller than that of the rotation shaft 28*a* cut on it, the rotation shaft 29*a* passes through a guide screw hole of the second traverse platform 27, so the platform 27 can be slid in the longitudinal direction of the rotation shaft 29*a* as the motor 29 rotates.

As the nozzle control part 30*a* is configured like this, the position of the nozzle in the vertical and right-and-left direction is fixed, and the initial position of the nozzle 18 can be set only in the back-and-forward direction by controlling the motor 28 and 29. After the wire 24 is engaged to the terminal of the bobbin 8, the motor 9A is operated to wind the wire 24 around the bobbin 8.

Next, the electric block diagram of the control device of the second embodiment will be explained with reference to FIG. 14.

In the drawing, an electric control device 62 having a CPU inside it and an interface on the input and output side, is controlled by the control program of a program input device 61.

The electric control device 62 is so configured so that, a spindle control circuit 80 for individually controlling a plurality of spindles is connected with a nozzle position control circuit 93 for controlling the position of nozzles for supplying wire, the spindle control circuit 80 and nozzle position control circuit 93 consists of a plurality of circuits respectively, and these circuits can be controlled in synchronism with each other respectively.

The spindle control circuit 80 is the same as that shown in FIG. 13 and explanation is omitted.

A nozzle position control circuit 93 is a circuit for controlling the position of the nozzles 18 shown in FIG. 3. The nozzle position is adjusted in the back-and-forth direction by a back-and-forth direction control circuit 84 and a back-and-forth direction fine adjusting circuit 91 using different motors respectively. The back-and-forth direction control circuit 84 is of configuration the same as that explained in the first embodiment. The back-and-forth direction control circuit 84 is to control the motor 28 connected to the first traverse platform 26 and having an encorder 94 fixed to it. The motor 28 is connected to the output terminal of the electric device 62 by way of a counter 74, a D/A converter 75, and an amplifier 76, starts to rotate by the control pulses of the electric control device 62, and stops the rotation when the number of the feedback pulses sent forth by the encorder 94 coincides with the number of the control pulses inputted.

The back-and-forth direction fine adjusting control circuit 91 is to control the motor 90 connected to the second traverse platform 27 and having an encorder 89 fixed to it. The motor 90 is connected to the output terminal of the electric control device 62 by way of a counter 86, a D/A converter 87, and an amplifier 88, starts to rotate by the control pulses of the electric control device 62, and stops the rotation when the number of the feedback pulses sent forth by the encorder 89 coincides with the number of the control pulses inputted.

These encorders 89 and 94 are configured so that each sends forth a datum position pulse when the rotation shaft of each of the motors 90 and 28 comes to a predetermined position in a rotation.

Accordingly, the electric control device 62 sends forth control pulses to allow each of the motors 90 and 28 to rotate until each datum position pulse comes in, and when it stops to send forth the control pulse, the nozzle is set on the initial position owing to the fact that each of the motors is automatically stopped by the feedback pulse of which the number of pulses coincides with that of the control pulses.

A signal wire of a magnetic valve 79 for switching the air supplied from an air compressor 59 to the air cylinder 36 through a piping 60 is connected to the output terminal of the electric control device 62.

Next, the operation of the winding apparatus of the second embodiment configured as described will be explained.

As shown in FIG. 4, the wire 24 from the spool 31 is stringed over the transit roller 57 and 58, and the tip of the wire 24 is allowed to hang down from the nozzle 18 as shown in FIG. 3.

Then, an input-output means 85 is manipulated to operate the nozzle position control circuit 93 in the state each bobbin 8 is attached to the bobbin attaching shaft of each spindle.

Hereupon, the back-and-forth direction control circuit 84 starts operation to set the first traverse platform 26 on the initial position.

The spindle control circuit 80 starts operation in synchronism with the operation start of the nozzle position control circuit 93 to set each bobbin 8 on the predetermined angle position. With this condition, the tip part of the wire 24 is engaged to the bobbin terminal, that is, the wire is turned around the terminal by hand or magic hand not shown. Then the tip part of the engaged wire is cut near the bobbin terminal.

Then, whether the wire 24 is stringed from the bobbin terminal in the vicinity of the bobbin flange to the nozzle parallel to the inner face of the flange, that is, the wire 24 is stringed perpendicular to the bobbin axis, is checked visually or by an inspection means not shown. If the wire 24 is not stringed perpendicular, the input-output means 85 is manipulated in order to send a fine adjusting pulse from the electric control device 62 to move the second traverse platform back-and-forth to set nozzle position.

Then, by manipulating the input-output means 85 to operate each spindle motor 9, each wire 24 is wind around each bobbin. In synchronism with this start of winding, the position of each nozzle 8 is controlled by the back-and-forth direction control circuit 84 in correspondence to the number of turns of the wire 24.

As the wire 24 is wound after stringed about parallel to the inside faces of front side and back side flanges of the bobbin by fine-adjusting the position of the nozzle 18 by the back-and-forth direction control circuit 91, it is prevented that the nozzle 18 is traversed with the wire 24 hitched on the inside faces of the bobbin.

As shown in FIG. 4, in the case in which the bobbin has a plurality of sections, that is, in the case of a section winding bobbin having partitions (flanges) for partitioning the take-up part into a plurality of sections (for example, a high pressure ignition coil with a large number of turns of thin wire), by shifting the nozzle by the motor 28 (the first rotation driving source) in the winding part and by shifting the nozzle by the motor 29 (the second driving source) in the flange part, the nozzle is shifted by the second rotation driving source in the partition for partitioning the winding part of the wind-up tool. As the shift of the nozzle in the partition is shorter than that in the winding part, the shift of the nozzle in the flange parts, i.e. partitions, of a bobbin having a plurality of winding section can be done with accuracy.

The wire winding apparatus of the third embodiment according to the present invention will be explained with reference to FIG. 10, 11, and 15.

Figure 10:
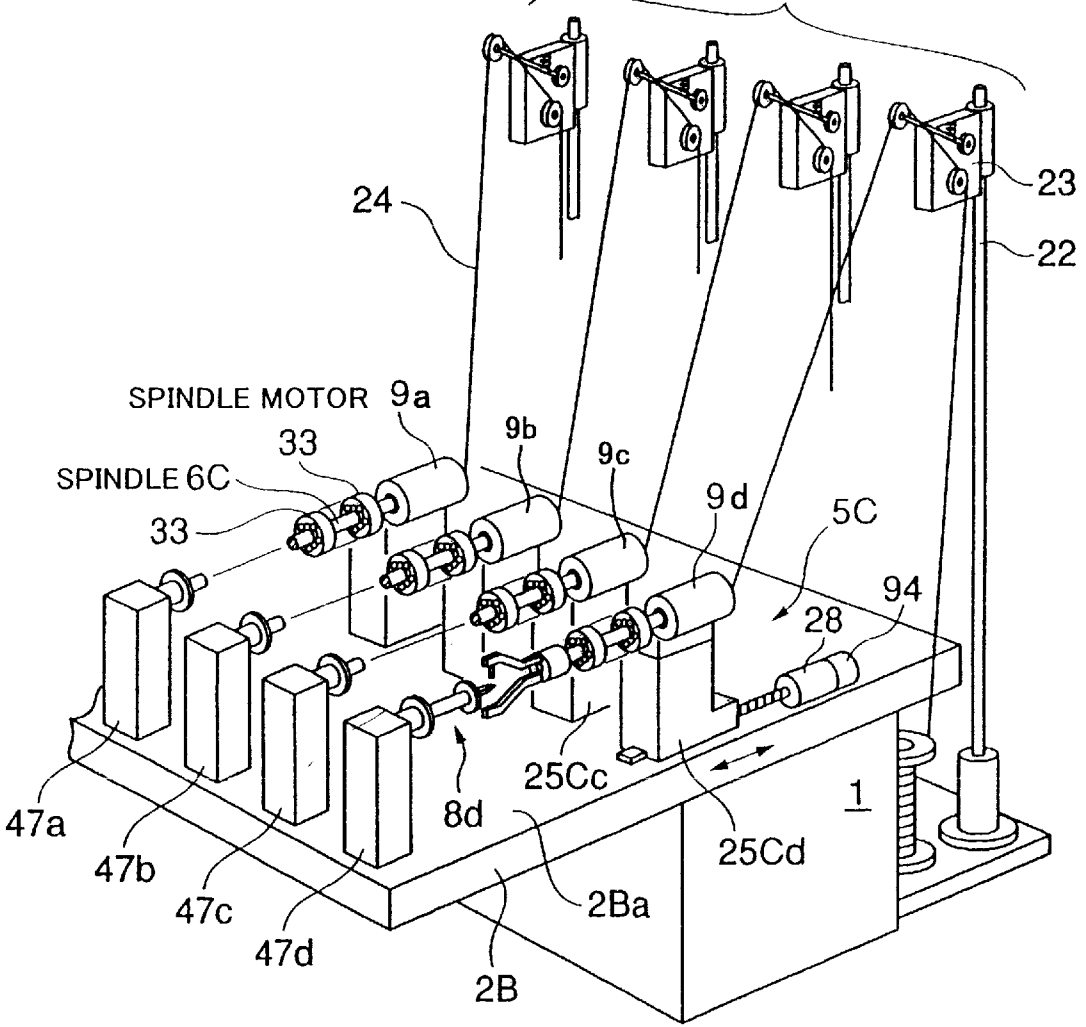
FIG. 10 is a perspective view of a wire winding apparatus of the third embodiment according to the present invention.
Figure 11:
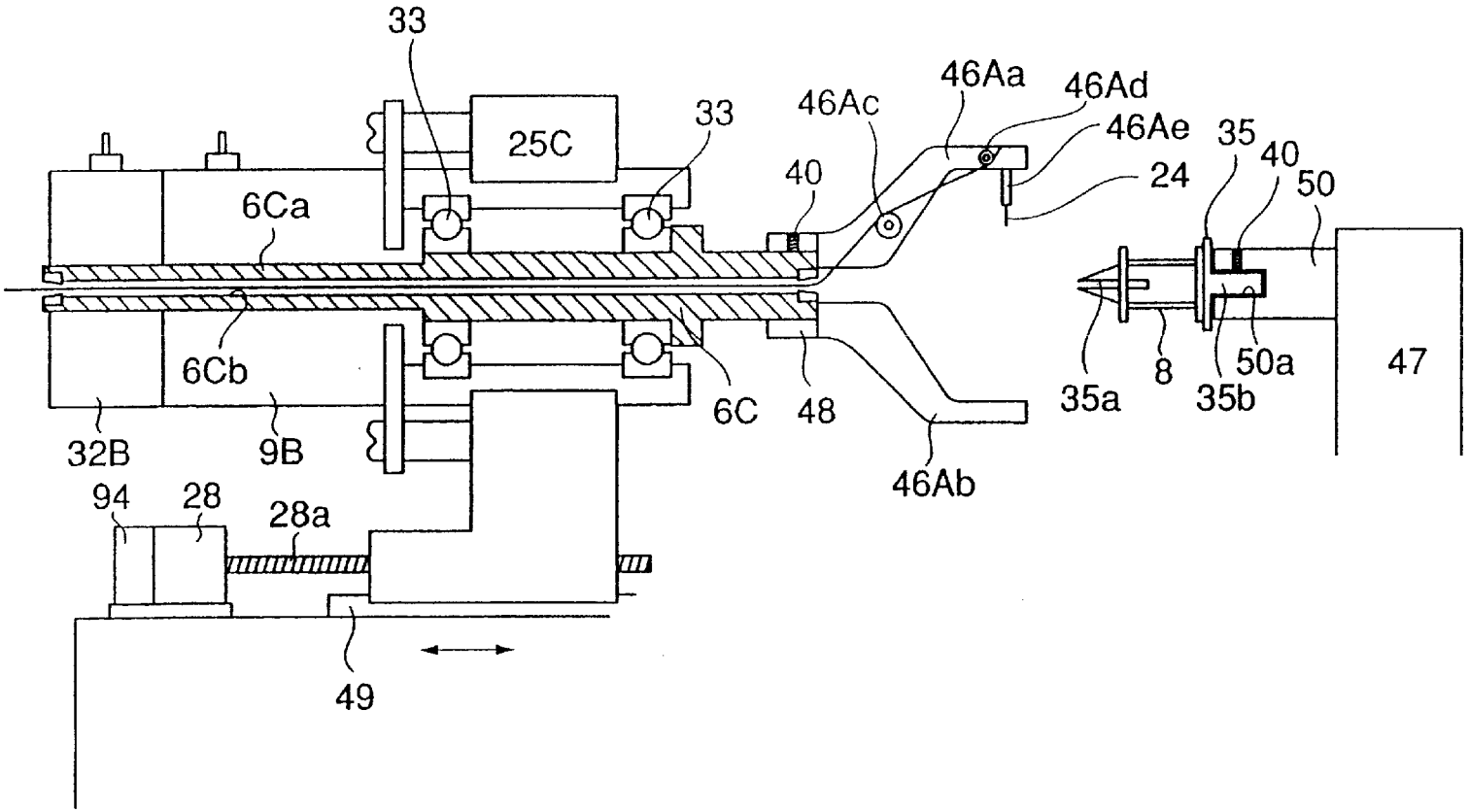
FIG. 11 is a section view showing the structure of flier and bobbin installing part of the third embodiment according to the present invention.
Figure 12:
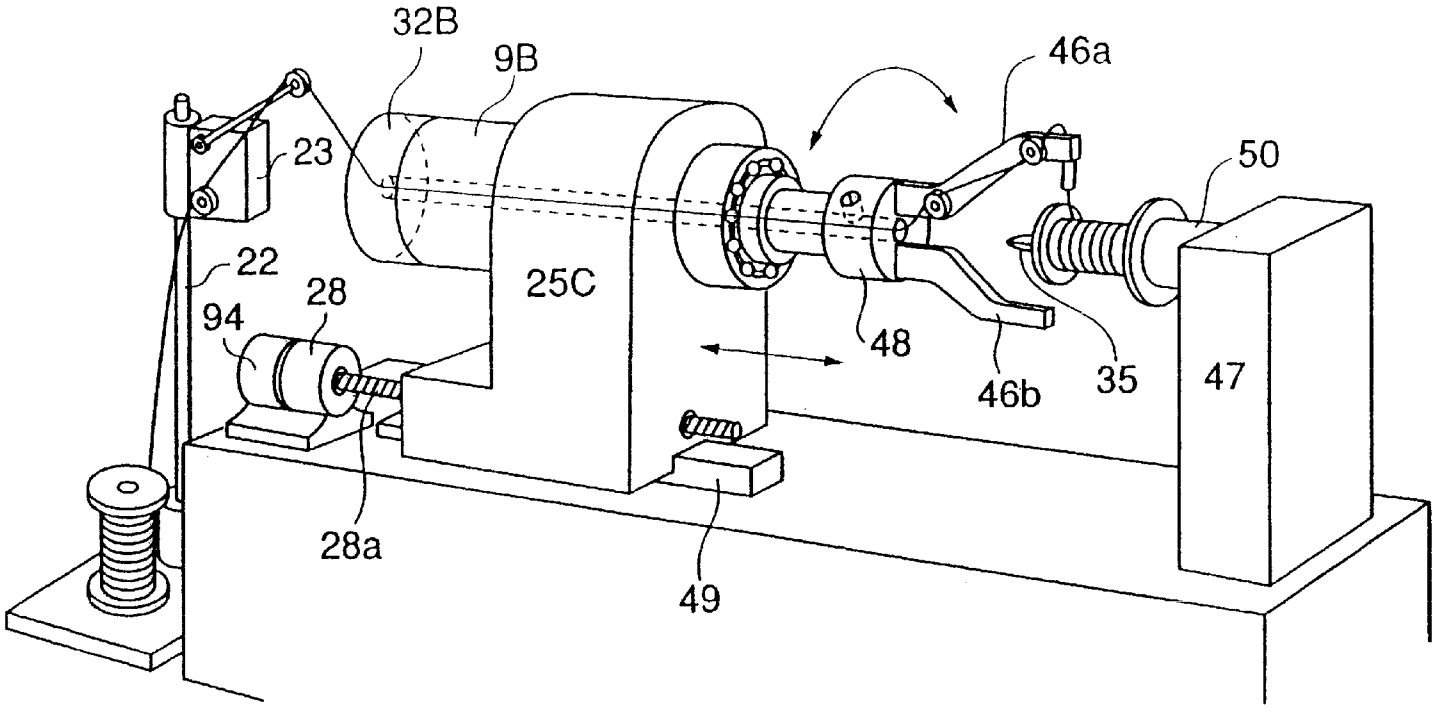
FIG. 12 is a perspective view of FIG. 11.
Figure 15:
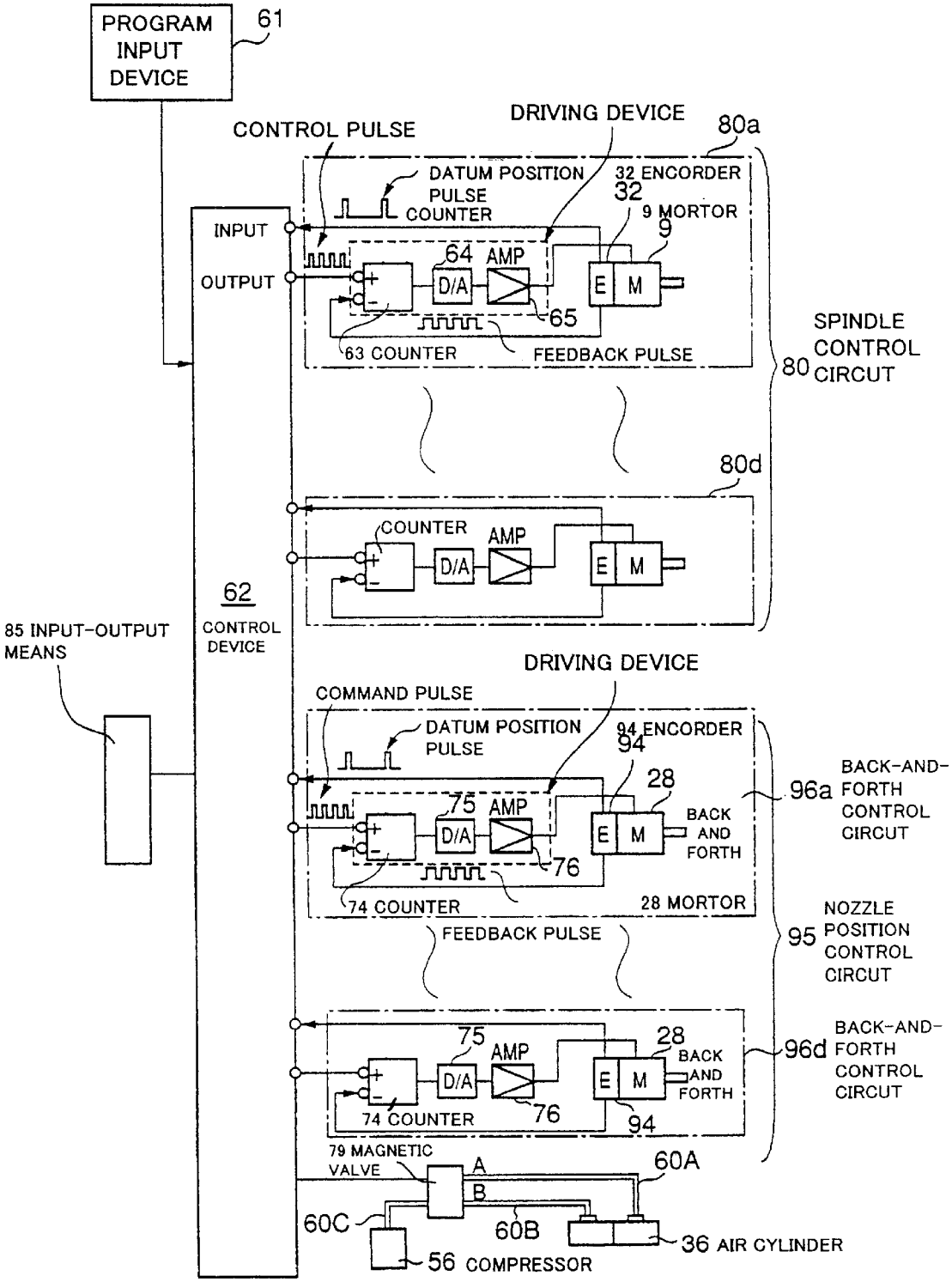
FIG. 15 is the electric block diagram of a control device in the third embodiment.
Figure 16:
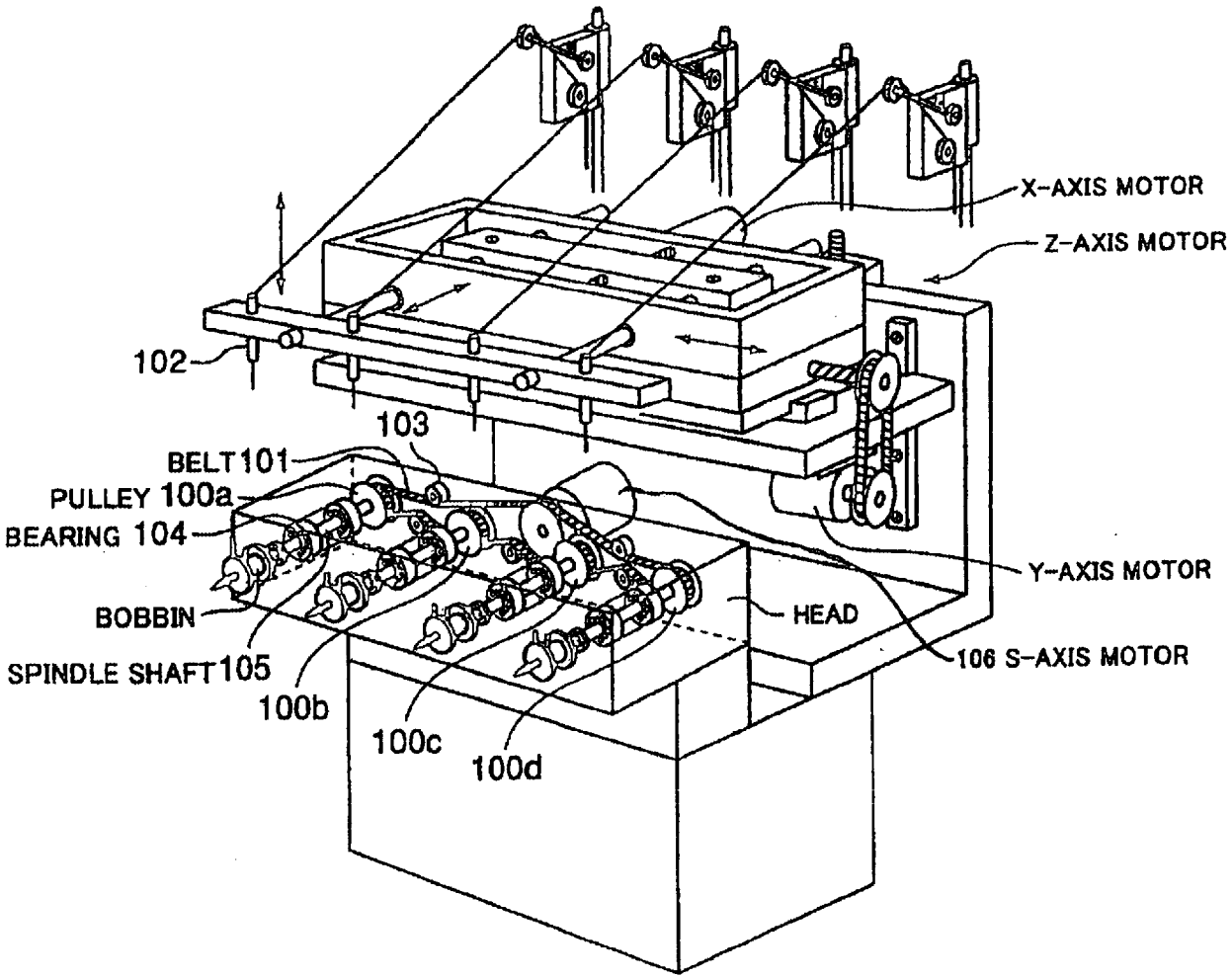
FIG. 16 PRIOR ART
FIG. 16 is a perspective view of a conventional wire winding apparatus.

FIG. 10 is a perspective view of the wire winding apparatus of the third embodiment, FIG. 11 is a section view showing the structure of flier and bobbin installing part of the third embodiment, FIG. 12 is a perspective view of FIG. 10, and FIG. 15 is the electric block diagram of a control device in the third embodiment.

The point of difference from the first embodiment is that, unlike the first embodiment in which a bobbin is attached to each spindle, each spindle is movable in a back-and-forth direction, a flier is attached to each spindle, and a bobbin is provided facing each flier in the third embodiment. Therefore, the position of the wire is adjusted by moving a winding head 25C back-and-forth instead of operating the wire position adjusting part 5A (FIG. 1). A wire position adjusting part 5C comprises winding heads 25C, motors 28 for moving the winding heads 25C back-and-forth, and encorders 94.

As shown in FIG. 10, a wire transit part 4 which has been explained in the explanation of FIG. 1 is provided in the rear of a base 1, and on the horizontal plane 2Ba of a base frame 2B are mounted winding heads 25C each of which is provided with each of spindles 6C, spindle motors 9, and fliers 46. Bobbins 8 are attached to bobbin attaching parts 47, each bobbin facing each of the fliers 46.

Next, the spindle 6, spindle motor 9, and flier 46 will be explained with reference to FIG. 11 and FIG. 12.

In FIG. 11, a motor 9B with an encorder 32B is attached to the winding head 25C, the spindle 6C is supported by bearings 33, 33 for rotation with its end part 6Ca inserted into the center of the motor 9B and encorder 32B.

The end part 6Ca of the spindle 6C is, for example, shaped to have an oval section, and the oval-shaped part engages with the concave part of the motor side.

A through hole 6Cb is machined in the center of the spindle 6C, and a wire 24 from the wire transit part 4 passes through the through hole 6Cb.

Fliers 46(Aa, Ab) are attached to the right end part of the spindle 6C by the medium of a fixing part 48 which is fixed by a set screw 40. The flier 46Aa is movable in the direction of the straight arrow in FIG. 12.

The flier 46Aa is provided with transit rollers 46Ac and 46Ad, and nozzle 46Ae. The wire 24 can be supplied toward the bobbin 8 by way of the transit rollers 46Ac and 46Ad, and nozzle 46Ae.

A bobbin shaft holder part 50 is attached facing the flier 46A to the attaching part 47. The bobbin holder 50 has a hole 50*a* into which the rear end side 35*b* of a bobbin attaching shaft 35 is inserted to be fixed by a set screw 40. A slit 35*a* is provided in the left end side of the bobbin attaching shaft 35 to cause friction between the shaft 35 and the bobbin 8A in order to hold the bobbin 8A on the shaft 35 so that the bobbin attached to the shaft 35 does not rotate and smooth winding is performed.

As shown in FIG. 12, the winding head 25C is movable in the direction of the straight arrow guided by a guide rail 49, a guide screw is cut on the rotation shaft 28*a* connected to the motor 28, the motor shaft 28*a* engages with the female guide screw cut in the winding head 25C. Thus, the winding head 25C is moved back-and forth as the motor 25C rotates.

Next, the electric block diagram of a control device of the third embodiment will be explained with reference to FIG. 15.

In the drawing, an electric control device 62 having a CPU inside it and an interface on each of input and output side, is controlled by the control program of a program input device 61.

The electric control device 62 is so configured so that, a spindle control circuit 80 for individually controlling a plurality of spindles is connected with a nozzle position control circuit 95 for controlling the position of nozzles for supplying wire, the spindle control circuit 80 and nozzle position control circuit 93 consists of a plurality of circuits respectively, and these circuits can be controlled in synchronism with each other respectively.

The spindle control circuit 80 is the same as that shown in FIG. 13 and explanation is omitted.

A nozzle position control circuit 95 is a circuit for controlling the position of the nozzle 46Ae shown in FIG. 11. The position of each nozzle is controlled through the back-and forth direction control circuits 96(a~d) by an individual motor. Each of the back-and-forth direction control circuits 96 is configured like that explained in the first embodiment.

The back-and-forth direction control circuit 96 is to control the motor 28 having an encorder 94 and connected to the flier 46. The motor 28 is connected to the output terminal of the electric control device 62 by way of a counter 74, a D/A converter 75, and an amplifier 76. The motor 28 starts rotation by the control pulses from the electric control device 62, and stops the rotation when the number of the feedback pulses sent forth by the encorder 32 coincides with that of the control pulses inputted.

The encorder 94 is configured so that it sends forth a datum position pulse when the rotation shaft of the motor 28 comes to a predetermined position in a rotation.

Accordingly, the electric control device 62 sends forth control pulses to allow each of the motor 28 to rotate until each datum position pulse comes in, and when it stops to send forth the control pulses, the nozzle is set on the initial position owing to the fact that each of the motors is automatically stopped by the feedback pulses of which the number of pulses coincides with that of the control pulses.

With this positioning, the wires 24 are engaged to the terminals of the bobbins 8, and after that the motors 9B are rotated for winding the wires around the bobbins 8.

A signal wire of a magnetic valve 79 for switching the air supplied from an air compressor 59 to the air cylinder 36 through a piping 60 is connected to the output terminal of the electric control device 62.

Next, the operation of the winding apparatus of the third embodiment configured as described will be explained.

As shown in FIG. 4, the wire 24 from the spool 31 is stringed over the transit roller 57 and 58, and the tip of the wire 24 is allowed to hang down from the nozzle 46Ae as shown in FIG. 11.

Then, a input-output means 85 is manipulated to operate the nozzle position control circuit 81 in the state each bobbin 8 is attached to the bobbin attaching shaft 35 of each spindle.

Hereupon, the back-and-forth control circuits 96(a~d) starts to operate, and the winding heads 25C are set on their initial positions. Although the position of the nozzle 46Ae relative to the inside face of the bobbin flange is predetermined according to the size of the bobbin, it is also possible to be adjusted by the input-output means 85 while visually observing.

With this condition, the tip part of the wire 24 is engaged to the bobbin terminal, that is, the wire is turned around the terminal by hand or magic hand not shown. Then the tip part of the engaged wire is cut near the bobbin terminal.

In synchronism with the completion of the initial position setting by the nozzle position control circuit 95, the spindle position control circuit 80(a~d) starts operation to rotate the flier 46 to wind the wire 24 around the bobbin 8. In synchronism with the start of winding, the position of the nozzle 18 is controlled by the back-and-forth direction control circuit 96(a~d) corresponding to the number of turns of the wire 24.

As heretofore detailed, according to the present invention, it is possible to engage wire without the failure caused by the deviation of position of the nozzle and bobbin terminal, because a driving source for rotating wind-up tool is provided for each wind-up tool in the first and second invention and because a driving source for rotating a wire supply part which supplies the wire to a stationary winding part is provided for each wire supply part in the third invention, unlike the case a plurality of wind-up tools are driven by a driving source by the medium of a belt.

Further, as a belt transmission mechanism is not used for driving a plurality of spindles, wire winding is possible with superior responsivity to command signal.

What is claimed:

1. A method of winding wire comprising providing an individual rotation driving source for each of a plurality of rotatable wind-up tools having an outer periphery parallel to its axis of rotation, and winding wire around the outer periphery of each said wind-up tool by rotating each rotation driving source to rotate the wind-up tools in synchronism with each other; wherein each rotation driving source is rotated by control pulses, feedback pulses of the same frequency as the control pulses are sent out from each rotation driving source, and wire is wound around the outer periphery of each wind-up tool by rotating each rotation driving source to rotate the wind-up tools in synchronism with each other through detecting the number of rotations of each rotation driving source by counting the number of the feedback pulses which is the same as the number of control pulses.

2. A method of winding wire comprising providing an individual rotation driving source for each of a plurality of rotatable wind-up tools having and outer periphery parallel to its axis of rotation, and winding wire around the outer periphery of each wind-up tool, wherein a wire feeding nozzle for each wind-up tool is provided in a position opposite each wind-up tool, wire is fed through each nozzle and wound around each wind-up tool while moving each wire feeding nozzle in a back-and-forward direction coinciding with the axis of rotation of the respective wind-up tool, and at least in a right-and-left direction perpendicular to the axis of rotation of the respective wind-up tool, wherein each rotation driving source is rotated by control pulses, feedback pulses of the same frequency as the control pulses are sent out from each rotation driving source, and wire is wound around the outer periphery of each wind-up tool while rotating each rotation driving source in synchronism with the others through detecting the number of rotations of each rotation driving source by counting the number of the feedback pulses which is the same as the number of the control pulses.

3. A method of winding wire according to claim 2, wherein an initial position of each wire feeding nozzle in a right-and-left and back-and-forward direction is set and after that each rotation driving source for rotating each wind-up tool corresponding to each wire feeding nozzle is rotated to set an initial angle position of each wind-up tool.

4. A method of winding wire according to claim 3, wherein after the initial angle position of each wind-up tool is set, winding of wire around each wind-up tool is started, movement of each nozzle in a right-and-left direction is controlled in accordance with the number of layers of wire wound around each corresponding wind-up tool, and movement of each nozzle in a back-and-forth direction is controlled in accordance with the number of turns of wire wound around each corresponding wire wind-up tool.

5. A method of winding wire around outer peripheries of a plurality of stationary wind-up tools of which the peripheries are parallel to axes, wherein wire is supplied through a hole of each of a plurality of spinning bodies each of which is located with a rotation axis coinciding with the axis of each said wind-up tool facing each said spinning body, an individual rotation driving source for supplying the wire is provided for each said spinning body, and each said rotation driving source rotates in synchronism with each other to wind the wire around each said wind-up tool; wherein the wire is supplied to the wind-up tool via a nozzle, and the nozzle is moved back-and-forth to set an initial position before the start of wire winding, and wherein the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

6. An apparatus for winding wire around outer peripheries of a plurality of rotating wind-up tools of which the peripheries are parallel to axes of rotation, comprising:

a plurality of rotatable wind-up tool holders for attaching each said wind-up tool, a plurality of rotation driving sources each of which is connected to each said wind-up tool holder for rotating each said wind-up tool, a rotation controller for controlling the rotation driving sources for rotating the wind-up tools in synchronism with each other, a plurality of nozzles for supplying wires to the wind-up tools, a tip part of each of the nozzles facing each of the wind-up tools, individual rotation driving sources provided for each of the nozzles to be moved up-and-down, right-and-left, and back-and-forth, and a plurality of nozzle position adjusters for adjusting the tip part of each of the nozzles to the proper position by controlling each of the rotation driving sources, wherein the position of each said nozzle is regulated by rotating each said rotation driving source.

7. An apparatus for winding wire according to claim 6, wherein the rotation driving source is driven by control pulses, feedback pulses of the same frequency as the control pulses are sent out from the rotation driving source, and the number of rotations of the rotation driving source is detected by counting the number of the feedback pulses which is the same as that of the control pulses.

8. An apparatus for winding wire around outer peripheries of a plurality of rotating wind-up tools of which the peripheries are parallel to axes of rotation, comprising:

a plurality of rotatable wind-up tool holders for attaching each said wind-up tool, a plurality of rotation driving sources each of which is connected to each said wind-up tool holder for rotating each said wind-up tool, and a rotation controller for controlling the rotation driving sources for rotating the wind-up tools in synchronism with each other, a plurality of nozzles for supplying wires to the wind-up tools, and a plurality of back-and-forth direction adjusters for moving each said nozzle in the direction of the rotation axis of each said wind-up tool holder, wherein the rotation driving source for moving the nozzle consists of a first and a second rotation driving source for moving the nozzle in the direction of the rotation axis of the wind-up tool during wire winding action, the moved distance of the nozzle by unit rotation of the second rotation driving source is smaller than that of the first rotation driving source, the initial position of the nozzle is adjusted by the second rotation driving source, the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

9. An apparatus for winding wire around outer peripheries of a plurality of rotating wind-up tools of which the peripheries are parallel to axes of rotation, comprising:

a plurality of rotatable wind-up tool holders for attaching each said wind-up tool, a plurality of rotation driving sources each of which is connected to each said wind-up tool holder for rotating each said wind-up tool, and a rotation controller for controlling the rotation driving sources for rotating the wind-up tools in synchronism with each other, a plurality of nozzles for supplying wires to the wind-up tools, a plurality of back-and-forth direction adjusters for moving each said nozzle in the direction of the rotation axis of each said wind-up tool holder, intermediate holders capable of detaching-and-attaching the wind-up tools, the wind-up tool holders capable of detaching-and-attaching the intermediate holders, and a releaser for releasing the holding forces of the wind-up tool holders for holding the intermediate holders, wherein the rotation driving source for moving the nozzle consists of a first and a second rotation driving source for moving the nozzle in the direction of the rotation axis of the wind-up tool during wire winding action, the moved distance of the nozzle by unit rotation of the second rotation driving source is smaller than that of the first rotation driving source, the initial position of the nozzle is adjusted by the second rotation driving source, and the wind-up tools and intermediate holders are capable of being detached/attached from or to the wind-up tool holders.

10. An apparatus for winding wire around outer peripheries of a plurality of stationary wind-up tools of which the peripheries are parallel to axes, comprising:

a plurality of said wind-up tools, nozzle parts for supplying wires, rotating bodies rotatable about the same axes as of the wind-up tools, each said rotating body being provided with each said nozzle part and located facing each said wind-up tool, and rotation driving source each of which is provided for rotating each said rotating body, wherein the wire winding around each said stationary wind-up tool is performed by rotating each said rotation driving source in synchronism with each other, and the rotation driving sources move each said rotating body having said nozzle part back-and-forth in the direction of the axis of the rotating body in order to adjust the position of each said rotating body to a proper position.

11. An apparatus for winding wire around outer peripheries of a plurality of stationary wind-up tools of which the peripheries are parallel to axes, comprising:

a plurality of said wind-up tools, nozzle parts for supplying wires, rotating bodies rotatable about the same axes as of the wind-up tools, each said rotating body being provided with each said nozzle part and located facing each said wind-up tool, and rotation driving source each of which is provided for rotating each said rotating body, wherein the wire winding around each said stationary wind-up tool is performed by rotating each said rotation driving source in synchronism with each other, the rotation driving source is rotated by control pulses, feedback pulses with the same frequency as the control pulses are sent out from the rotation driving source, and the number of rotations of the rotation driving source is detected by counting the number of the feedback pulses which is the same as that of the control pulses.

12. A method of winding wire comprising:

providing an individual rotation driving source for each of a plurality of rotatable wind-up tools having an outer periphery parallel to its axis of rotation;

providing a wire feeding nozzle for each of said plurality of wind-up tools, each said nozzle being positioned such that a tip part of each nozzle faces the respective wind-up tool, and feeding wire through each nozzle and winding the wire around the periphery of each wind-up tool while moving each wire feeding nozzle in a back-and-forward direction which coincides with the axis of rotation of the wind-up tool and at least in a right-and-left direction which is perpendicular to the axis of rotation of the wind-up tool, wherein a first transfer means and a second transfer means are used for moving said nozzle in a back-and-forward direction coinciding with the axis of rotation of the wind-up tool, said second transfer means being connected integrally to said first transfer means and moving parallel to the first transfer means;

each wind-up tool has a wire winding section divided in said back-and-forward direction into a plurality of wire winding zones, and the first transfer means moves the nozzle to each zone, and the second transfer means controls wire winding in said wire winding zones.

13. A method of winding wire according to claim 12, wherein said first transfer means and second transfer means are each moved by a conversion means for straight movement for each transfer means, and the movement of each nozzle is controlled such that the length of the movement per rotation of the rotation driving source of the second transfer means is smaller than the length of the movement per rotation of the rotation driving source of the first transfer means.

14. An apparatus for winding wire comprising:

an individual rotation driving source for each of a plurality of rotatable wind-up tools having an outer periphery parallel to its axis of rotation;

a wire feeding nozzle for each of said plurality of wind-up tools positioned such that a tip part of each nozzle faces each wind-up tool, means for feeding wire through each nozzle and winding the wire around the periphery of each wind-up tool while moving each wire feeding nozzle in a back-and-forward direction which coincides with the axis of rotation of the wind-up tool and at least in a right-and-left direction which is perpendicular to said axis, and a first transfer means and a second transfer means for moving said nozzle in the direction of the axis of rotation of the wind-up tool, said second transfer means being integrally connected to said first transfer means and moving parallel to the first transfer means; wherein each wind-up tool has a wire winding section divided into a plurality of zones in a back-and-forward direction coinciding with its axis;

the nozzle is moved to each zone by the first transfer means, and wire winding in the wire winding zones is controlled by the second transfer means.

15. An apparatus for winding wire according to claim 14, wherein said first and second transfer means comprise a transfer platform and a first and second guide screw shaft; each guide screw shaft being connected to a respective rotation driving source, and wherein the transfer platform is transferred by rotation of the first or second guide screw, and each guide screw has a pitch which differs from each other so that the length of transfer of the nozzle attached to the transfer platform per rotation of the second rotation driving source is smaller than the length of transfer per rotation of the first rotation driving source.

* * * * *